US009663946B2

(12) United States Patent
Frederick

(10) Patent No.: US 9,663,946 B2
(45) Date of Patent: May 30, 2017

(54) CURTAIN WALL MULLIONS, TRANSOMS AND SYSTEMS

(71) Applicant: STEELGLAZE, INC., Merrill, WI (US)

(72) Inventor: Todd Frederick, Merrill, WI (US)

(73) Assignee: FreMarq Innovations, Inc., Merrill, WI (US)

( * ) Notice: Subject to any disclaimer, the term of this patent is extended or adjusted under 35 U.S.C. 154(b) by 0 days.

(21) Appl. No.: 14/932,631

(22) Filed: Nov. 4, 2015

(65) Prior Publication Data

US 2016/0053487 A1 Feb. 25, 2016

Related U.S. Application Data

(63) Continuation-in-part of application No. 14/314,636, filed on Jun. 25, 2014, now Pat. No. 9,212,482.

(60) Provisional application No. 61/943,786, filed on Feb. 24, 2014.

(51) Int. Cl.
*E04B 2/96* (2006.01)
*E04B 2/90* (2006.01)

(52) U.S. Cl.
CPC . *E04B 2/96* (2013.01); *E04B 2/90* (2013.01)

(58) Field of Classification Search
CPC . E04B 2/965; E04B 2/967; E04B 2/96; E04B 2/88
See application file for complete search history.

(56) References Cited

U.S. PATENT DOCUMENTS 3,488,906 A * 1/1970 Brooks ..... E04B 2/96 52/235
3,866,374 A 2/1975 Dallen
(Continued)

FOREIGN PATENT DOCUMENTS

| | | |
|---|---|---|
| CA | 2863016 A1 | 12/2014 |
| EP | 1020579 A2 | 7/2000 |
| EP | 1342861 A1 | 9/2009 |

OTHER PUBLICATIONS

PCT International Searching Authority, International Search Report and the Written Opinion of the International Searching Authority, and Search History, Feb. 16, 2017 (consisting of a total of 13 pages).

*Primary Examiner* — Brian Glessner
*Assistant Examiner* — Adam Barlow
(74) *Attorney, Agent, or Firm* — Anthony J. Bourget

(57) ABSTRACT

A curtain wall mullion or transom including a unitary component made of a thermally insulating material bonded to a metal structural segment or fastened, from the inside-out, to an outer side of the metal segment such that a stem of the component extends into a pocket defined by panels of a curtain wall system. The component may be a reinforced fiberglass polymer component and bonded to the metal segment with an adhesive and may isolate the metal structure from the atmosphere outside the curtain wall and may include a seal receiver which abuts a panel of the curtain wall. The metal segment may be made of steel or aluminum or other metal. A pultrusion method is used to make the fiberglass component to have a profile configured to cover an entirety of an outside of the mullion or transom and to have a pair of receivers for receiving seals to abut against panels of the curtain wall.

33 Claims, 18 Drawing Sheets

(56) References Cited

U.S. PATENT DOCUMENTS

| | | | | | |
|---|---|---|---|---|---|
| 3,968,608 | A * | 7/1976 | Swango | E04B 2/96 | 52/127.12 |
| 4,015,390 | A * | 4/1977 | Howorth | E04B 2/967 | 411/84 |
| 4,648,231 | A * | 3/1987 | Laroche | E04D 3/08 | 24/459 |
| 4,942,711 | A * | 7/1990 | Bergquist | E04D 3/08 | 52/204.591 |
| 4,977,717 | A * | 12/1990 | Niwata | E04B 2/967 | 52/204.593 |
| 4,996,809 | A * | 3/1991 | Beard | E04B 1/0046 | 52/200 |
| 5,356,675 | A * | 10/1994 | Unger | E04B 1/0046 | 428/33 |
| 8,011,146 | B2 * | 9/2011 | Krause | F41H 5/263 | 52/235 |
| 2008/0222978 | A1 | 9/2008 | Salzer | | |
| 2010/0293882 | A1 | 11/2010 | Labrecque et al. | | |
| 2013/0186031 | A1 | 7/2013 | Ting | | |

* cited by examiner

CURTAIN WALL MULLIONS, TRANSOMS AND SYSTEMS

CROSS-REFERENCE TO RELATED APPLICATIONS

The present application is a continuation-in-part of, and claims priority to, co-pending U.S. patent application Ser. No. 14/314,636, filed Jun. 25, 2014, approved as U.S. Pat. No. 9,212,482 issue on Dec. 15, 2015, which claims the benefit and priority of Provisional Patent Application Ser. No. 61/943,786 filed Feb. 24, 2014, for CURTAIN WALL MULLIONS, TRANSOMS AND SYSTEMS under 35 U.S.C. §119(e), which are hereby incorporated by reference as if fully reproduced herein.

BACKGROUND OF THE INVENTION

There are curtain wall systems or frameworks in which glazing or other panels are fitted. Curtain walls typically comprise a grid-like framework usually made of aluminum profiled members arranged with transoms (i.e., structures that typically run horizontally) and mullions (i.e., structures that typically run vertically). Glazing or window panels and non-transparent panels may be secured against the transoms and mullions. The framing is attached to a building structure.

SUMMARY OF THE INVENTION

The invention pertains to a curtain wall system and separate elements such as mullions or transoms that include a thermally insulating component. In some embodiments, the insulating component is a fiberglass component such as a fiberglass reinforced polymer that is bonded to a metal structure. The metal structure may be made of steel or aluminum for instance. The bonding is accomplished using adhesives and/or other bonding techniques and produces a mullion or transom having sufficient strength to support the panels or glazing of the curtain wall. The thermally insulating fiberglass component enhances the insulating properties of the mullions, transoms and curtain wall system.

In accordance with an aspect of the invention, a steel mullion or transom includes a stem projecting from the mullion or transom where the stem is configured to project into a space between a first panel and a second panel of a curtain wall. Since the stem is made of thermally insulating material the structure provides enhanced overall insulating properties of a resultant curtain wall system.

In a further aspect of the invention, a mullion or transom for use on a curtain wall system having at least one panel comprises a metal structural segment and a component made of thermally insulating material and bonded to the metal segment, the component including a seal receiver configured to receive a seal to be positioned between the metal segment and the panel In a further aspect of the invention a curtain wall system includes a cell having a first mullion, a second mullion, a first transom and a second transom, the first transom including a metal structure having a fiberglass component bonded to the metal structure, a panel secured to the cell, the fiberglass component including a stem configured to support a weight of the panel.

In a further aspect the invention includes a method of making a component by pultruding a fiberglass to have a profile configured to cover an entirety of an outside of a mullion or transom of a curtain wall and to have a pair of receivers for receiving seals to abut against panels of the curtain wall. Further profiles are contemplated under the methods of making components by pultrusion.

In a further aspect of the invention a metal curtain wall mullion or transom has an outer side and a component connected to the outer side by a first fastener passing through the outer side and into the component. The fastener is inserted from the inside-out, i.e., from the inside of the metal structure, through the outer side, and into the component.

The above partial summary of the present invention is not intended to describe each illustrated embodiment, aspect, or every implementation of the present invention. The figures and detailed description and claims that follow more particularly exemplify these and other embodiments and further aspects of the invention.

BRIEF DESCRIPTION OF THE DRAWINGS

The invention may be more completely understood in consideration of the following description of various embodiments of the invention in connection with the accompanying drawings, in which.

Figure 1:
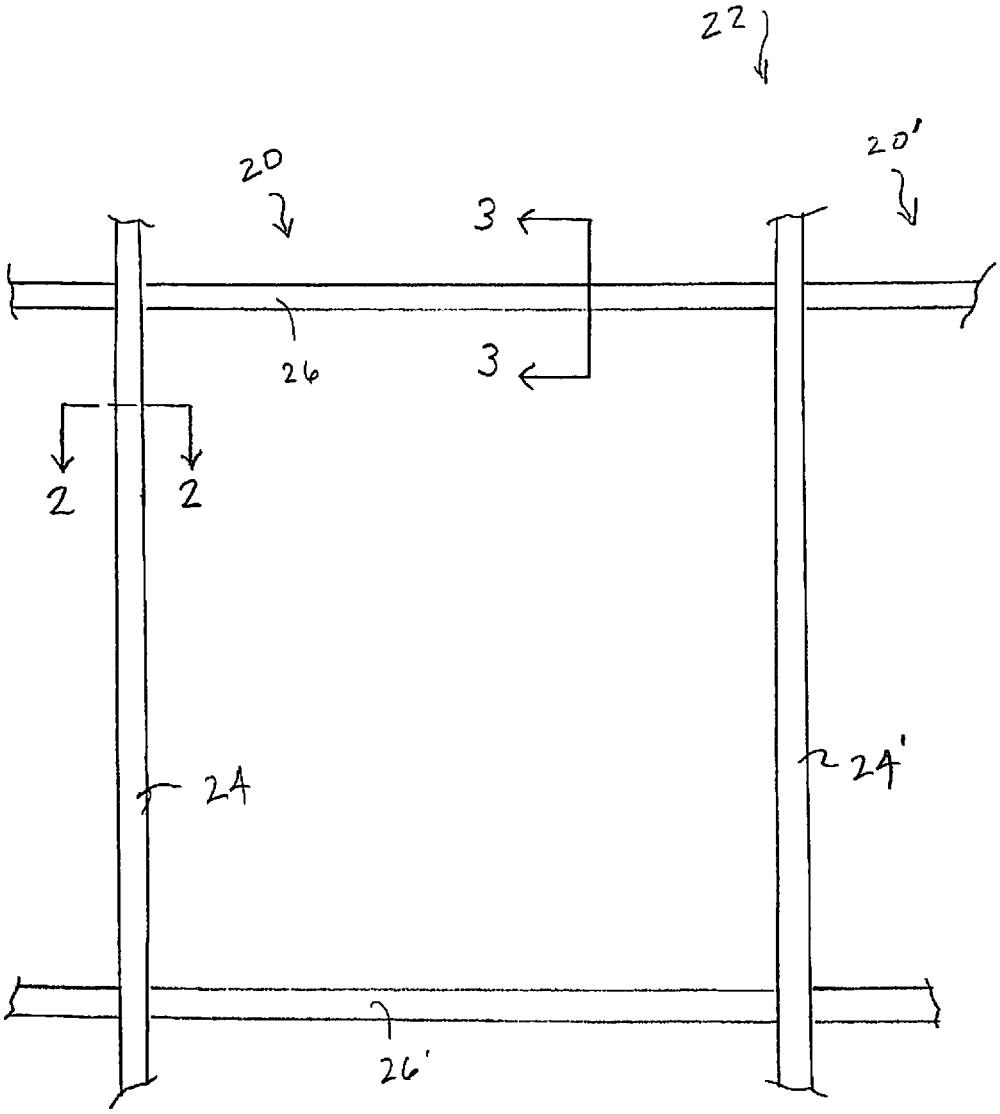
FIG. 1 is a front view of a cell of a curtain wall system according to some embodiments of the present invention.

While the invention is amenable to various modifications and alternative forms, specifics thereof have been shown by way of example in the drawings and will be described in detail. It should be understood, however, that the intention is not necessarily to limit the invention to the particular embodiments, aspects and features described. On the contrary, the intention is to cover all modifications, equivalents, and alternatives falling within the spirit and scope of the invention and as defined by the appended claims.

DETAILED DESCRIPTION OF THE INVENTION

Figure 2:
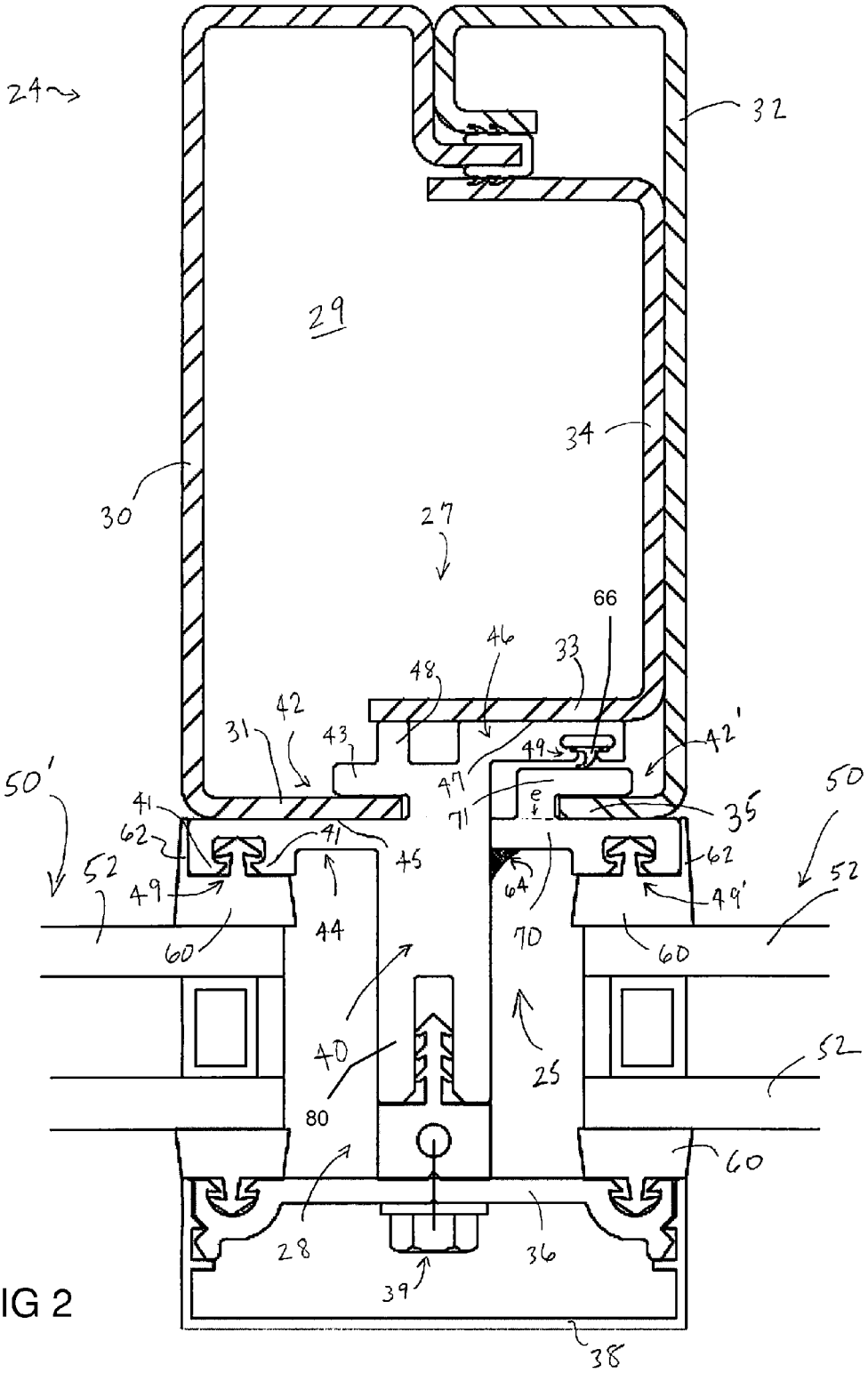
FIG. 2 is a sectional view of a mullion along line 2-2 of FIG. 1, according to some embodiments.

FIG. 1 is a front view of a cell 20 of a curtain wall system 22 according to some embodiments. System 22 is shown in partial (and panels are not shown). It may be appreciated that multiple cells 20 may comprise system 22. FIG. 2 is a sectional view of a mullion 24 of cell 20. FIG. 3 is a sectional view of a transom 26 of cell 20. A similar transom 26' is positioned generally parallel with transom 26. A similar mullion 24' is positioned generally parallel with mullion 24. Together mullions 24, 24' and transoms 26, 26' comprise a single cell 20 of curtain wall system 22. It may be appreciated that mullions 24 and transoms 26 also comprise additional cells 20' or components of cells 20' of system 22. It may be appreciated that panels such as windows, glass, or plates or other objects may be inserted within a cell 20 to cover or span the space, light or opening created by mullions 24 and transoms 26.

As shown in FIG. 2, mullion 24 includes a first mullion segment 30. In some embodiments mullion 24 includes a second mullion segment 32 and a third mullion segment 34. Mullion segments 30, 32 and 34 form a mullion 24 and define a mullion cavity 29. In some embodiments mullion 24 is made of steel. Particularly, segments 30, 32 and 34 may be made of steel. In one example, segments 30, 32 and 34 may be formed by bending 12 gage steel sheets. In one aspect mullion 24 includes a polymer component 40 which is bonded to mullion 24. Polymer component 40 is formed of a thermally insulating material. In one aspect polymer component 40 is made of fiberglass reinforced polymer (FRP) or glass-fiber reinforced polymer (GFRP) which in one example is a fiber reinforced polymer including plastic. A variety of glass, fiberglass and/or plastics may be used. In one aspect polymer component 40 is made of material including fiberglass and polyester, or fiberglass and vinyl ester, or fiberglass and polymers, and may include non-fire retardant materials or fire retardant materials. Polymer component 40 may be made using a pultrusion process and may include reinforcing structures or mats to provide structural support. Rovings may be located in the component 40 which may also include an external coating or coatings. Polymer component 40 thus has favorable insulating features. In one aspect involving steel structural segments 30, 32 and 34, polymer component 40 fills a gap that would otherwise lead from outer side 25 to cavity 29.

In one aspect polymer component 40 is bonded to mullion 24 with an adhesive. A variety of bonding ingredients and techniques may be used to secure polymer component 40 to mullion 24. As shown in one aspect, polymer component 40 includes an interlock 42 which is configured to receive tail 31 of first mullion segment 30. Tail 31 may be both friction fit within interlock 42 and also bonded within interlock 42 with an adhesive and/or bonding treatments. In one aspect interlock 42 is a gap defined by polymer component 40. Polymer component 40 may include a lip 43 which in part defines interlock 42 as shown. Polymer component 40 also includes a first arm 44 having a tail-contact surface 45 which is bonded to the outside surface of tail 31. In one aspect, tail contact surface 45 covers the entire area of the outside surface of tail 31. In this manner tail 31 is not exposed to the outside element which would otherwise tend to corrode or deteriorate tail 31. Polymer component 40 also includes a second arm 46 having a tail contact surface 47 which in one aspect may be bonded to the outside surface of tail 33 of third mullion segment 34. In one aspect tail contact surface 47 may cover the entirety of the outside surface of tail 33. It may be appreciated that contact surface 47 may also cover less than the entirety of the outside surface of tail 33. Polymer component 40 may also include a further lip 48 configured to adhere to tail 33. In further aspects arm 46 may loosely fit against tail 33 (i.e., not be bonded) so that arm 46 may slide with respect to tail 33. Likewise, lip 48 may also be a loose fit against tail 33. It may be appreciated that alternative configurations of polymer component 40 may be used to assist in adhering polymer component 40 to mullion 24 (whether adhering to segment 30, 32 or 34). Polymer component 40 is configured to adhere to mullion 24 while also having a stem portion 80 extending between or into a gap or pocket defined in part by panels 50, 50'. A fastener 39 may insert through a pressure plate 36 and into the stem to secure panels 50, 50' in position. Seals 60, 60 may be positioned between pressure plate 36 and panel frame 52. A cover plate 38 may be positioned to cover pressure plate 36. It may be appreciated that panel 50 may be positioned within cell 20 while panel 50' may be positioned within an adjacent cell 20'.

In a further aspect polymer component 40 includes a seal receiver 49 configured to receive a seal 60. In one aspect seal receiver is defined by seal fingers 41. Seal 60 is configured to insert into seal receiver 49 and between first arm 44 and panel frame 52. Seal 60 may fiction fit to panel frame 52 and may also be bonded to panel frame 52. Seal 60 may be of a conventional variety used in curtain wall systems. Seal 60 may also include a wrap segment 62 to partially cover an edge of first arm 44. In a further aspect polymer component 40 includes a further seal receiver 49 positioned at or defined by second arm 46. In one aspect seal receiver 49 may be configured to receive a seal 66 configured to interact with a shoulder 70 described below. In one aspect seal 66 is positioned between second mullion segment 32 and third mullion segment 34.

As shown in FIG. 2 mullion 24 includes a shoulder 70 connected to second mullion segment 32. In one aspect shoulder 70 includes an interlock 42'. Interlock 42' is configured to receive tail 35 of segment 32. Tail 35 may friction fit within interlock 42' and/or be bonded to shoulder 70 within interlock 42'. Shoulder 70 is made from the same or similar material as is polymer component 40 described above. In one aspect shoulder 70 abuts polymer component 40. A sealant 64 may be applied where shoulder 70 meets polymer component 40. In a further aspect shoulder 70 includes a seal receiver 49'. Receiver 49' is configured to receive a seal 60. In one aspect seal receiver 49' is defined by seal fingers 41. Seal 60 is configured to insert into seal receiver 49' and between shoulder 70 and panel frame 52. Seal 60 may friction fit to panel frame 52. Seal 60 may be of a conventional variety used in curtain wall systems. Panel frame 52 may also be secured to seal 60 with an adhesive. Seal 60 may also include a wrap segment 62 to partially cover an edge of shoulder 70. In a further aspect shoulder 70 may be configured without elbow 71 (i.e., elbow extends from shoulder 70 at line "e" as shown in FIG. 2). Tail 35 may extend further toward tail 31 to lessen a gap there between. Shoulder 70 may friction fit or interlock and/or bond to tail 35.

It may be appreciated that polymer component 40 and shoulder 70 combine to cover the entirety of the outer side 25 of mullion 24. Particularly, polymer component 40 and shoulder 70 are configured such that no portion of mullion 24 is exposed to outer side 25, nor is any segment of mullion 24 in communication with the panels 50, 50' or the pocket 28 between panels 50, 50'. Maintaining the segments of mullion 24 in isolation from the outside atmosphere improves the insulating characteristics of system 22.

As shown, mullion 24 is a composite structure made of steel segments 30, 32, 34 to which the fiberglass items, such as polymer component 40 and shoulder 70 are bonded or laminated. Polymer component 40 and shoulder 70 are configured to remain connected to mullion 24. In one aspect polymer component 40 and shoulder 70 are continuous in that they span the length of mullion 24.

Figure 3A:
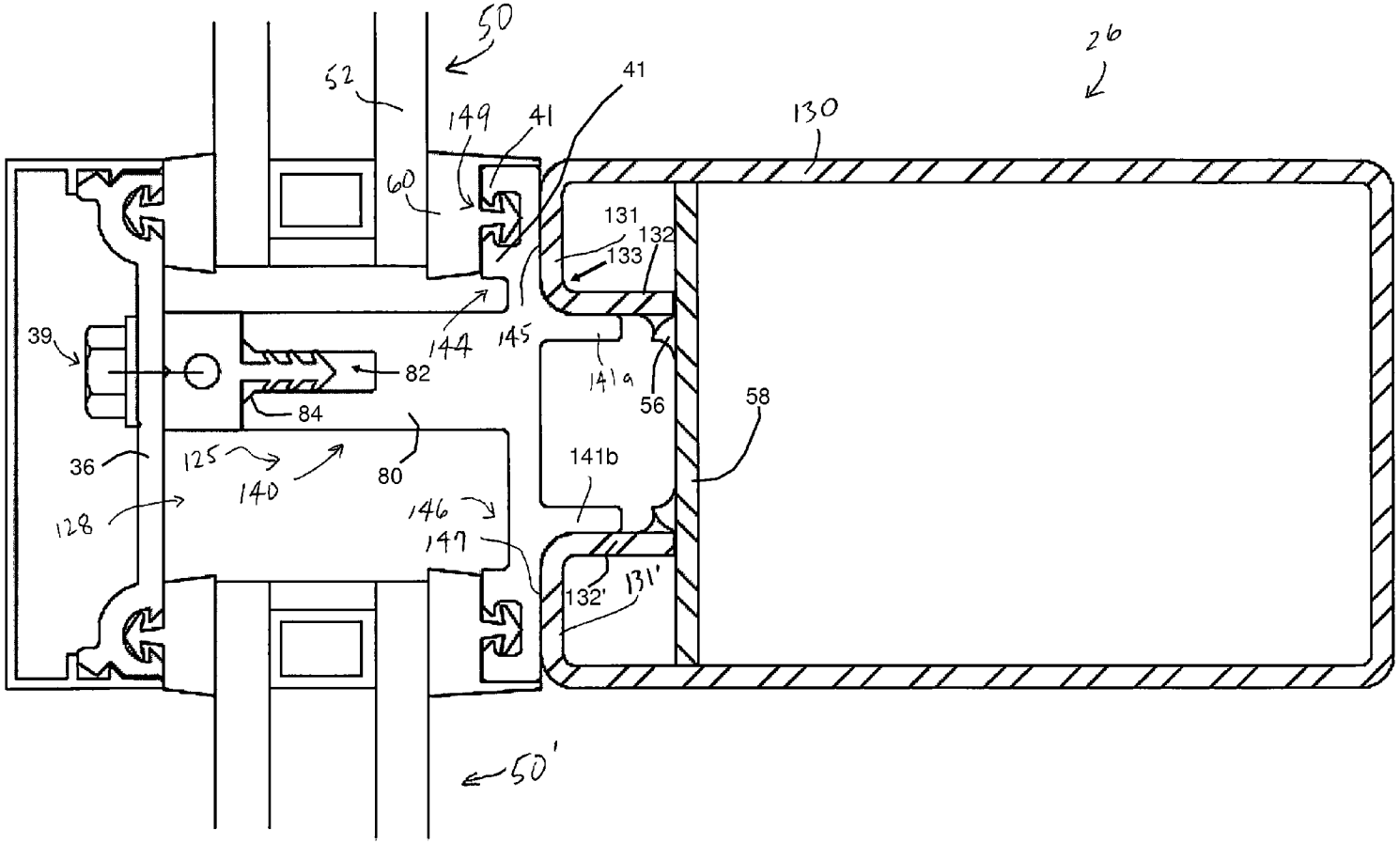
FIG. 3A is a sectional view of a transom along line 3-3 of FIG. 1, according to some embodiments.

As shown in FIG. 3A, transom 26 (i.e., a horizontally oriented element of cell 20) includes polymer component 140 which is made of material that is the same or similar to the material used to make polymer component 40 referenced above. Polymer component 140 includes a first arm 144 having a transom contact surface 145 and a second arm 146 having a transom contact surface 147. In one example component 140 is bonded to transom 26 at least at contact surfaces 145, 147. Particularly, first arm 144 and second arm 146 may be bonded with an adhesive and other bonding techniques to transom wall 130. Wall 130 is formed of metal and in one aspect is formed of steel and in one aspect is bent into configuration.

As shown in FIG. 3A, wall 130 includes receiving arm 131, 131'. In one aspect arm 131 is integrally connected to wall 130 and is configured to receive contact surface 145. Receiving arm 131 may be bent into position as shown for instance in FIG. 3 and then welded to transom plate 58 at weld 56. In one aspect receiving arm 131 leads to receiving hand 132 and hand 132 is in turn welded to transom plate 58 with weld 56. It may be appreciated that hand 132' may be oriented parallel or at least substantially parallel with hand 132. As such, hand 132 and hand 132' are opposing walls. Polymer component 140 further includes fingers 141*a*, 141*b* configured to bond with wall 130. In one aspect finger 141*a* is bonded to hand 132 and finger 141*b* is bonded to hand 132'. An adhesive may be applied between polymer component 140 and wall 130 to securely bond component 140 along an entirety of the exterior surface of arm 131 and continuing about the curve 133 and along hand 132. Likewise an adhesive may be applied to securely bond component 140 along an entirety of the exterior surface of arm 131' and continuing about the curve and along hand 132'. It may be appreciated that the combination of adhesive and the structural matching arrangement of fingers 141 combine to provide a secure bond sufficient to allow component 140 to withstand the forces associated with bearing the weight of panels 50, 50' and other forces associated with or applied to the panels.

Fingers 141*a*, 141*b* also allow for efficient alignment of component 140 onto wall 130. Fingers 141 are positioned on component 140 to match the gap between hands 132, 132' and to also receive an adhesive between component 140 and wall 130. Wall 130 is bent with corners 133 to match the contour of finger 141*a* (and/or vice versa) and the same is presented with finger 141*b* and at a distance to match the gap between hands 132, 132', to provide a secure bond. A variety of steps for preparing the surfaces and/or curing or treating the adhesives, as needed, may be used to achieve a secure bond of component 140 to wall 130. It may be appreciated that fingers 141 may be positioned in different locations, and in some applications may be reconfigured into different shapes/dimension and/or removed altogether.

It may be appreciated that polymer component 140 covers the entirety of outer side 125 of transom 26. Such configuration assures that no portion of transom 26 is in communication with the exterior atmosphere or panels 50, 50' or the pocket 28 between panels 50, 50'. Maintaining such isolation improves the insulating characteristics of system 22.

In a further aspect polymer component 140 includes a seal receiver 149. Receiver 149 is configured to receive a gasket or seal 60. In one aspect seal receiver is defined by seal fingers 41. Seal 60 is configured to insert into seal receiver 149 and between component 40, 140, and panel frame 52, i.e., between first arm 144 and panel frame 52. Seal 60 may be bonded to panel frame 52. Seal 60 may be of a conventional variety used in curtain wall systems.

In one aspect a pressure plate 36 is fastened with a screw 39 to stem 80 of component 140 and applies pressure to seals 60 which in turn apply pressure to panels 50, 50' and against component 140. It may be appreciated that a setting block may be positioned between stem 80 and panel 50. It may be appreciated that component 140 together with pressure plate 36 secure panels 50, 50' to transom 26.

Figure 3B:
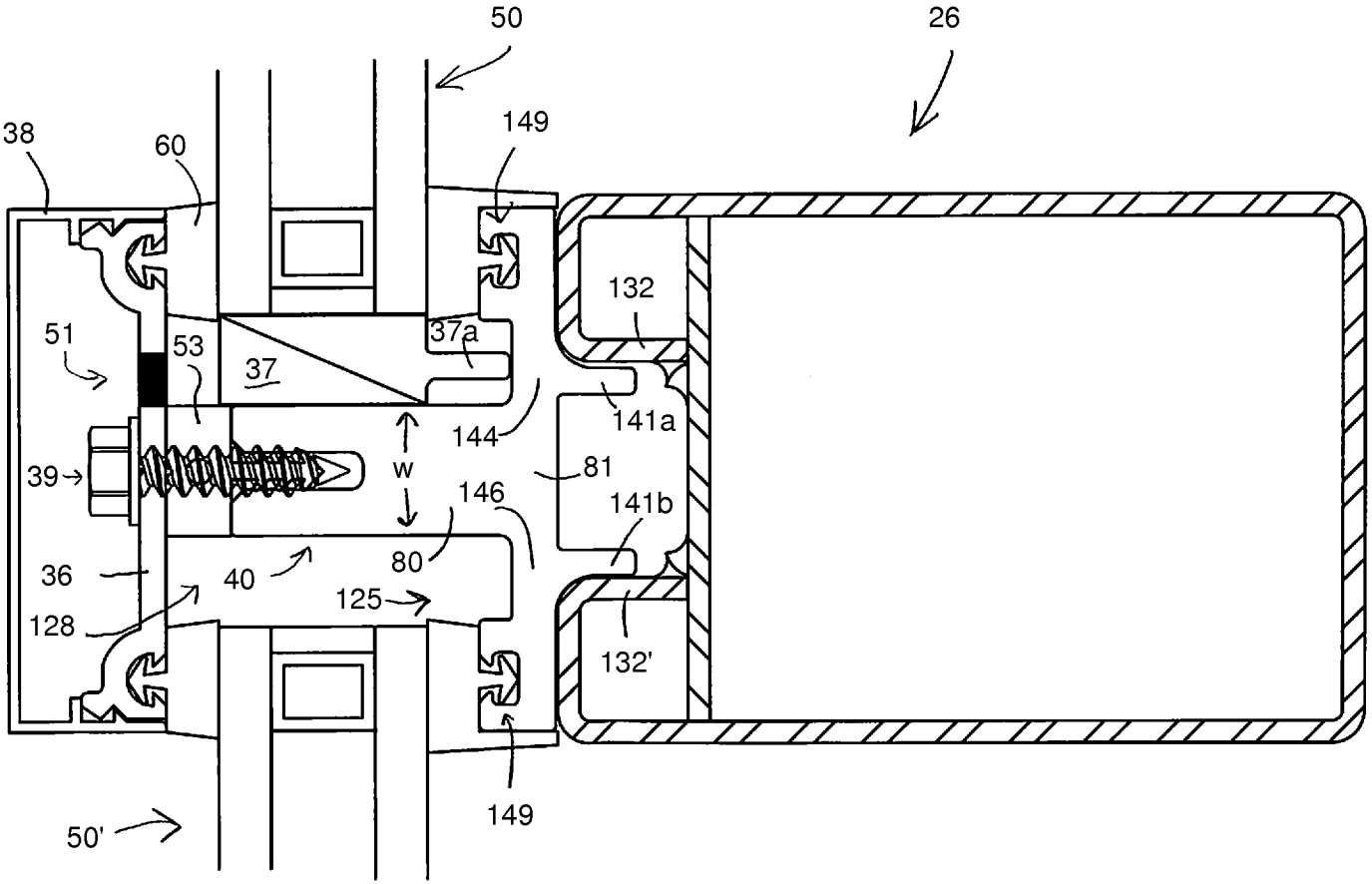
FIG. 3B is a sectional view of a transom along line 3-3 of an alternative aspect of FIG. 1, according to some embodiments.

In a further aspect the stem 80 includes a groove 82 configured to receive a fastener 39 (see also FIG. 3B). Groove 82 may include a taper 84 to assist in receiving fastener 39. Groove 82 may be a continuous groove which spans the length of component 40, 140. It may be appreciated that groove 82 operates as a pilot hole to receive and contain fastener 39. In one aspect groove 82 is configured to securely receive a fastener such as a screw, including a #14 stainless steel HWH SMS screw. A plurality of screws 39 may be inserted along transom to secure a plurality of panels 50, 50' into position. In one instance screws 39 may be positioned at 9 inches on center. Other arrangements may be used as desired.

FIG. 3B shows a further aspect of transom 26 having a symmetrically disposed polymer component 140. Also shown is a setting block 37 positioned between component 140, particularly, between the stem 80 of component 40, and a panel 50. In one example setting block 37 is a silicone block of about 4 inches to 6 inches in length. Block 37 may also be a continuous length to match the length of transom 26 or in other examples may be a shorter length. Block 37 may include a block tip 37*a* which is a projection from block 37 configured to abut component 40 for appropriate spacing of block 37 beneath panel 50 within pocket 128. In one example a number of setting blocks 37 may be used and staggered at various locations along the system 22. Blocks 37 may be positioned at quarter points along panel 50, for example. Block 37 or blocks 37 allow for the weight of a panel 50 to be transferred to the stem 80 or polymer component 40. Use of blocks 37 may also be employed with reference to FIG. 5 and FIG. 7. In this manner the weight of panels 50 is supported by polymer component 40. Pressure plate 36, which is secured to polymer component 40 by a fastener 39, for instance, applies pressure to seals 60, 60, which in turn apply pressure to panels 50,50'. In one aspect seal 60 may include, for instance, a 60 durometer silicone gasket. The interior side seal 60 may include a lineal or molded corner configuration for instance. Pressure plate 36 may also include a weep hole 51 which is an aperture defined by plate 36. Weep hole 51 allows for moisture to escape from pocket 128. A gasket, such as gasket 53 may be positioned between pressure plate 36 and stem 80. Gasket 53 may include a silicone material, such as a 70 durometer silicone gasket separator. It may be appreciated that polymer component 40 extends into pocket 128 between panels 50, 50'. Pressure plate 36 may extend a length of transom 26. Pressure plate 36 may include several weep holes 51 spaced at various positions along the length of plate 36. In one example weep hole 51 may be positioned on pressure plate 36 at a position above polymer component 40 as shown. This allows water or moisture to escape from below panel 50.

Figure 3C:
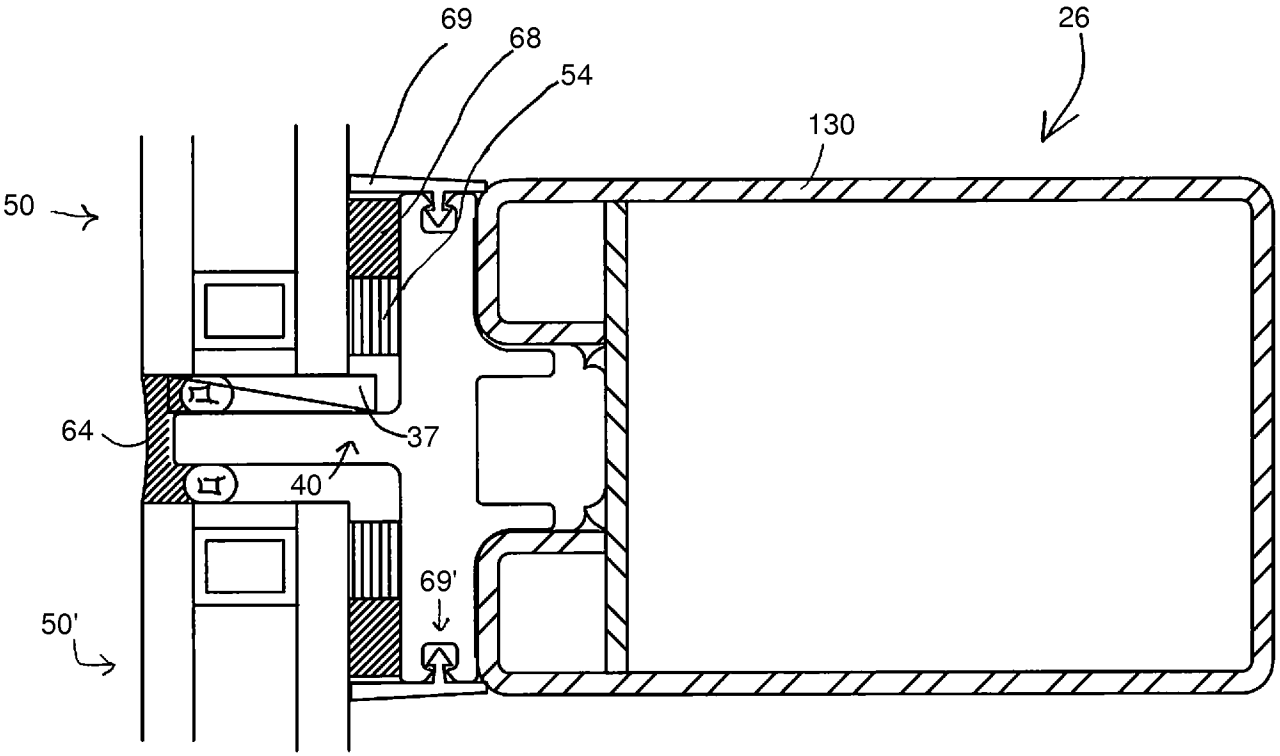
FIG. 3C is a sectional view of a transom along line 3-3 of an alternative aspect of FIG. 1, according to some embodiments.

FIG. 3C shows a further aspect of transom 26 having a symmetrically disposed polymer component 140. In this aspect the transom 26 includes a glazing tape 54 between panel 50 and component 40. In one aspect glazing tape 54 is a two sided glazing tape. Use of glazing tape 54 secures panel to polymer component 40 which is in turn secured to transom wall 130. In addition, a silicone layer 68 such as structural silicone is also positioned between panel 50 and component 40. Together the glazing tape 54 and structural silicone 68 secure panel to transom 26 while also maintaining a seal relationship. A silicone gasket 69 is positioned at an edge of component 40 and structural silicone 68 for additional insulation and/or for cosmetic purposes to conceal the structure. Gasket 69 inserts into a gasket receiver 69' of component 40. A similar arrangement may also be used to secure panel 50' to transom 26. It may be appreciated that use of glazing tape 54 and structural silicone 68, for instance, allows for securing panel 50 to transom 26 without the use of a fastener such as shown the FIG. 3A or FIG. 3B. A sealant 64 may be applied between panels 50, 50', for instance, and/or applied to stem 80 of component 40. A setting block 37 may also be used to receive panel 50.

Figure 3D:
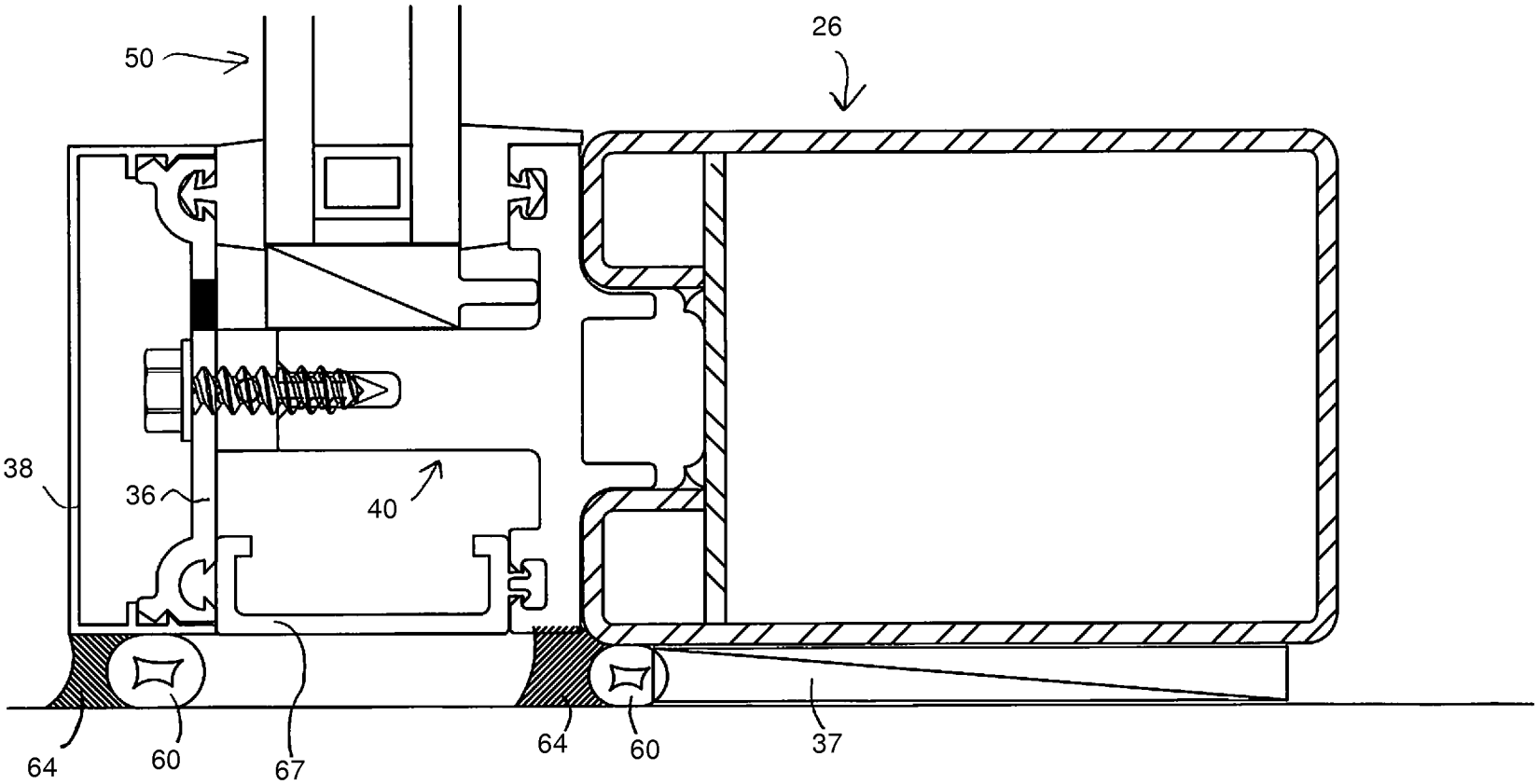
FIG. 3D is a sectional view of a transom positioned along a bottom wall of an alternative aspect of FIG. 1, according to some embodiments.

FIG. 3D shows a further aspect of transom 26 having a symmetrically disposed polymer component 40 and where the transom 26 is positioned adjacent a horizontal (such as at a bottom area of a curtain wall system). A single (upper) panel 50 is used in this aspect. A PVC spacer 67 is positioned between pressure plate 36 and component 40. A sealant 64 and seal 60 may be positioned between the horizontal and cover plate 38 and at the joint of component 40 and transom wall 130. A setting block 37 may be used to set transom 26.

Figure 4:
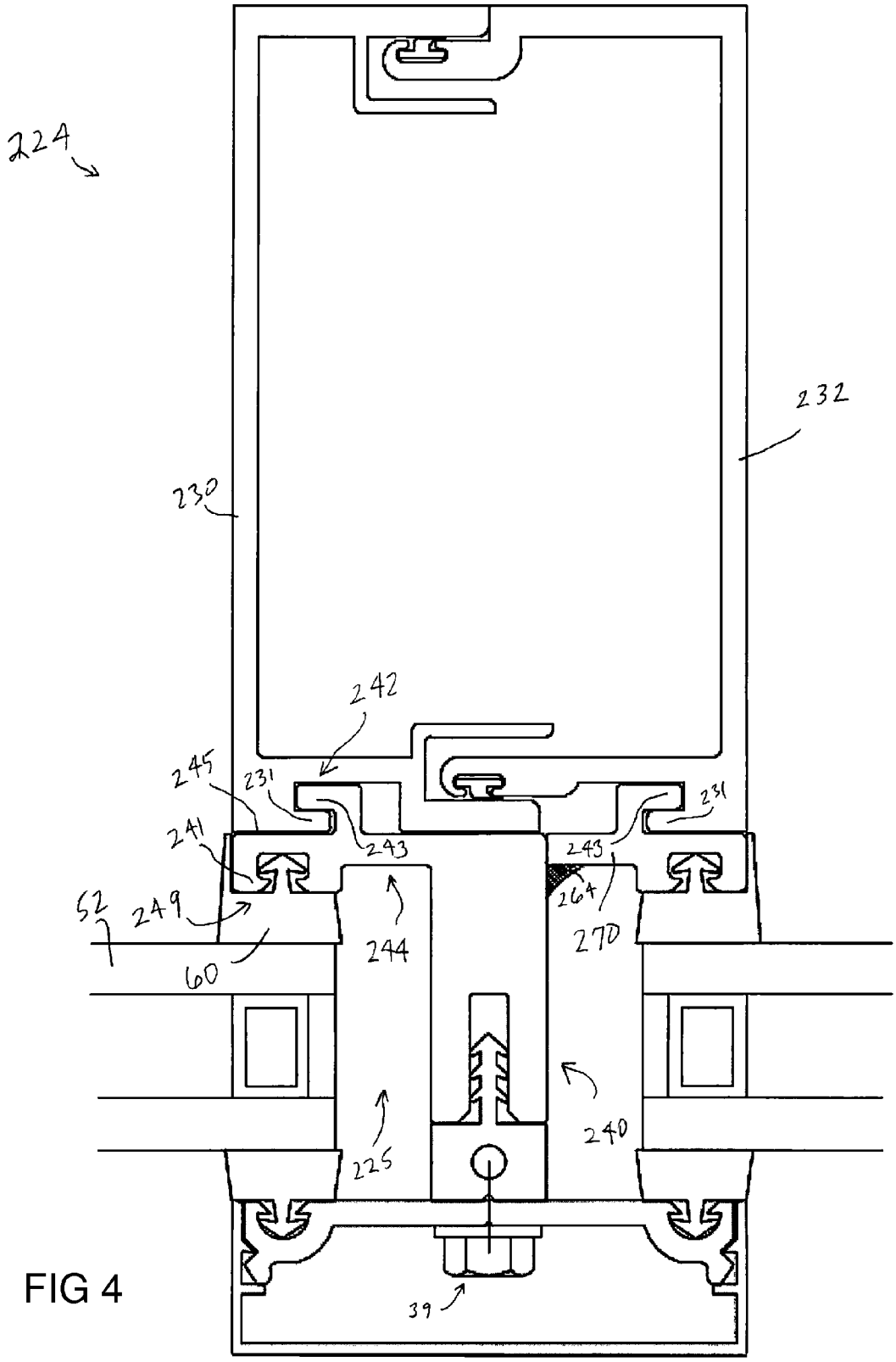
FIG. 4 is a sectional view of a mullion along line 2-2 of FIG. 1, according to some further embodiments involving use of aluminum.

As shown in FIG. 4, a further aspect of the invention is shown where mullion 224 is made of aluminum. Mullion 224 is made of a first mullion segment 230 and a second mullion segment 232. A polymer component 240 is bonded to mullion 224. In one aspect polymer component 240 is bonded, by an adhesive and other bonding techniques, to segment 230. Polymer component 240 may include an interlock 242 to receive a mullion finger of segment 230. Interlock 242 in one aspect is configured as part of first arm 244. First arm 244 may include a lip 243 which inserts into a gap defined by segment 230. Adhesive is applied to the surfaces to bond first arm 244 to segment 230. Bonding treatments and procedures are used to assure a rigid connection. In one aspect contact surface 245 is bonded to segment 230. Polymer component 240 further includes seal receiver 249. Receiver 249 is configured to receive a seal 60. In one aspect seal receiver is defined by seal fingers 241. Seal 60 is configured to insert into seal receiver 249 and between first arm 244 and panel frame 52. Seal 60 may be bonded to panel frame 52. Seal 60 may be of a conventional variety used in curtain wall systems.

As shown in FIG. 4, transom 224 further includes shoulder 270 laminated or bonded to mullion 224. Particularly shoulder 270 is rigidly connected to segment 232. Shoulder 270 includes interlock 242 which may be the same or similar to interlock 242 defined by polymer component 240. Segment 232 may also include tail 231 which may be friction fit and/or bonded within gap formed by lip 243. Shoulder 270 abuts polymer component 240 and may include seal 264. Shoulder 270 may further include seal receiver 249 to receive seal 60. Shoulder 270 and polymer component 240 are bonded to mullion 224 at outer side 225 and prevent mullion 224 from communication with panels 50, 50' or pocket 228.

Figure 5:
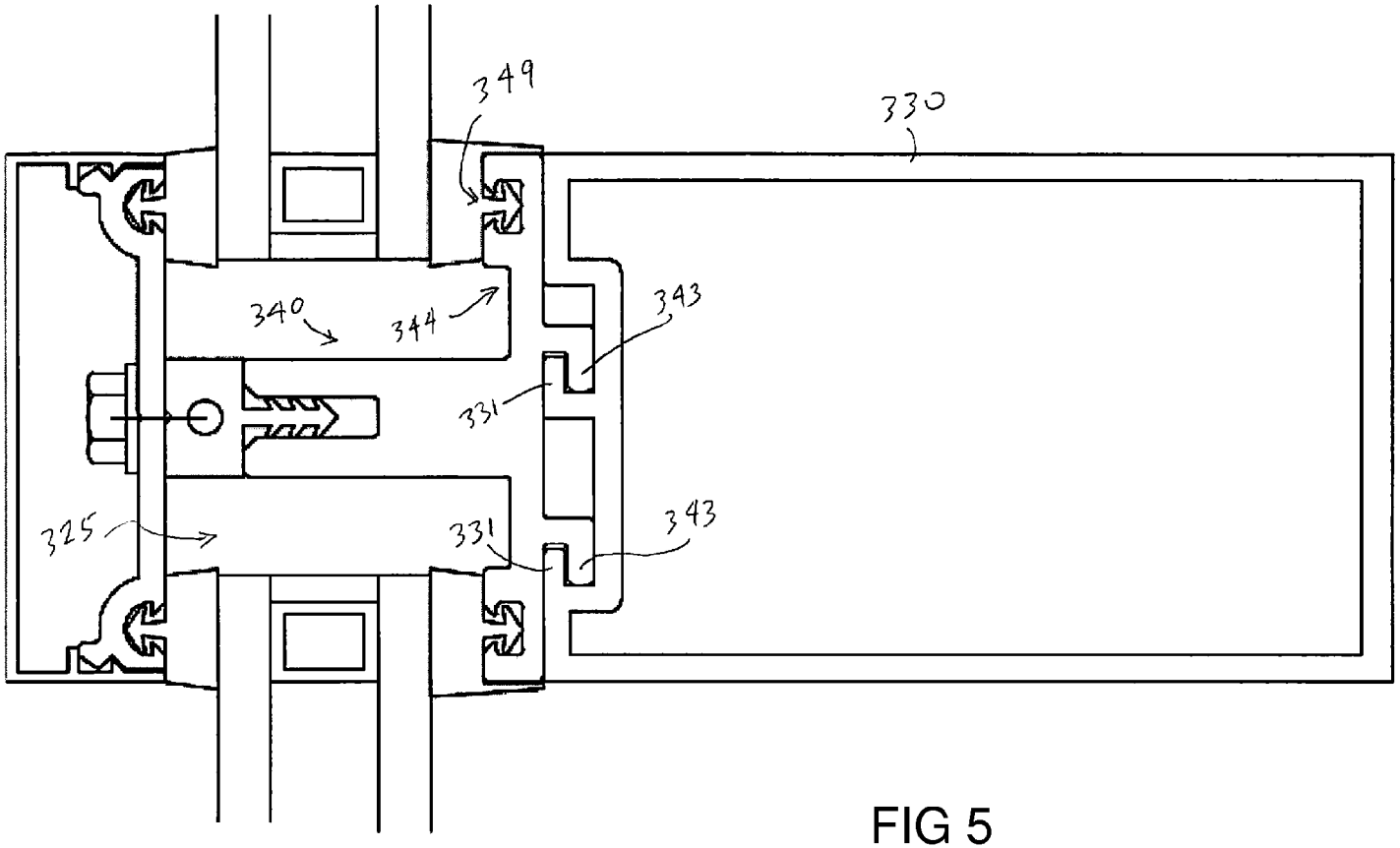
FIG. 5 is a sectional view of a transom along line 3-3 of FIG. 1, according to some further embodiments involving use of aluminum.

With reference to FIG. 5, a further aspect of transom 326 is shown which includes transom wall 330. Polymer component 340 is bonded to transom 326. Polymer component 340 is made of the same or similar material as is the polymer component 40 noted above. Polymer component 340 is configured to friction fit and/or bond with or to outer side 335 of transom 326. In one aspect polymer component 340 includes a lip 343 which inserts into a gap formed in part by tail 331 of transom wall 330. Transom 326 may be made of aluminum and may be extruded, for instance. Lip 343 and tail 331 create an interlock 342. Polymer component 340 further includes a first arm 344 which includes a seal receiver 349. Receiver 349 is configured to receive a seal 60. In one aspect seal receiver is defined by seal fingers 341. Seal 60 is configured to insert into seal receiver 349 and between first arm 344 and panel frame 52. Seal 60 may be bonded to panel frame 52. Seal 60 may be of a conventional variety used in curtain wall systems. Polymer component 340 in this aspect completely covers outer side 325 of transom 326.

Figure 6:
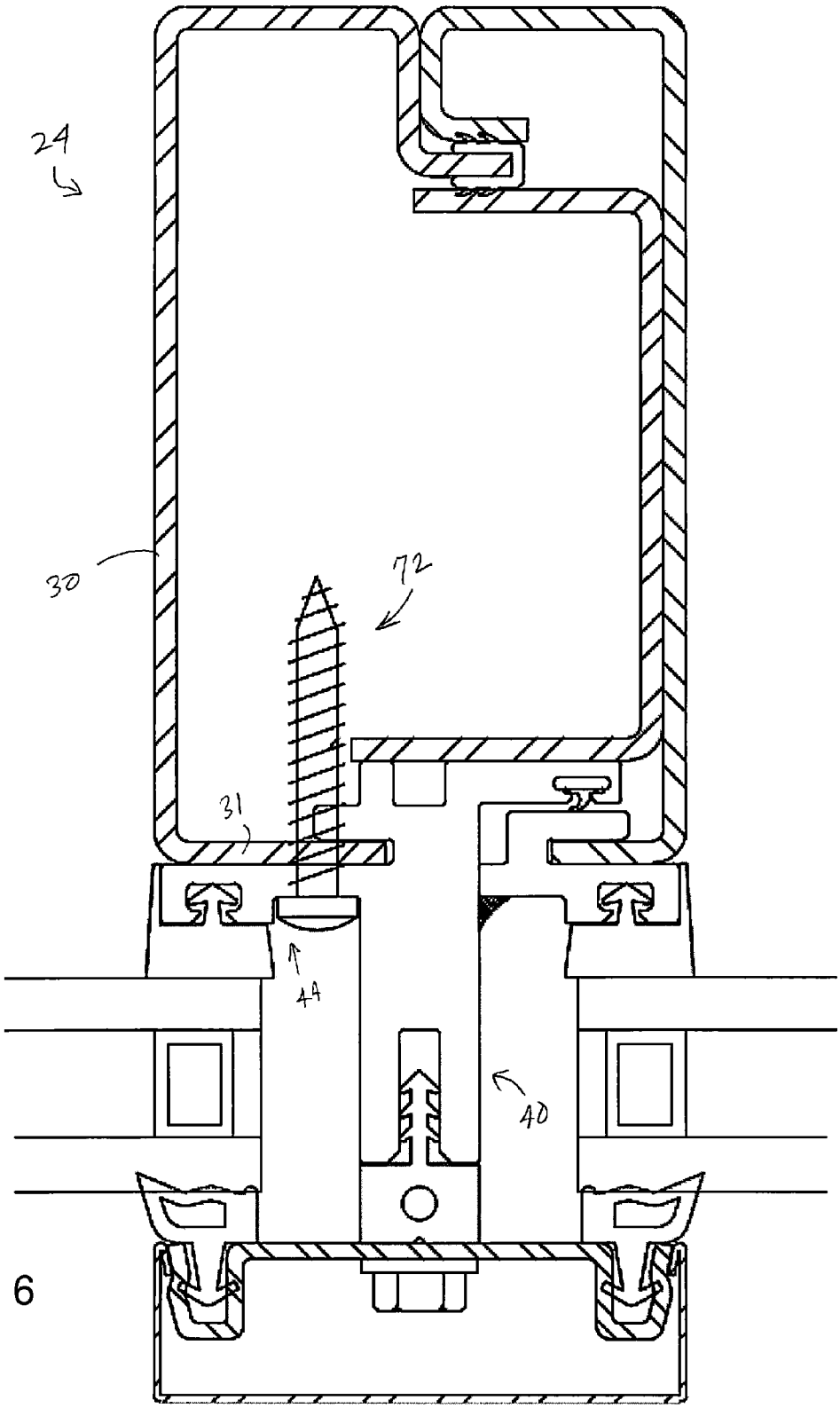
FIG. 6 is a sectional view of a mullion along line 2-2 of FIG. 1, according to some further embodiments.

With reference to FIG. 6, an alternative mullion 24 which is similar to the mullion 24 of FIG. 2 further includes a fastener 72 such as a screw. Fastener 72 includes additional support to further inhibit separation of polymer component 40 from mullion 24. In one aspect fastener 72 is positioned through first arm 44 of polymer component 40 and through tail 31 of steel segment 30. A sealant may also be inserted to cover the head of fastener 72 and to seal the opening (or edges of the opening) which is created by fastener 72. Use of fastener 72 provides enhanced protection in the event of a fire situation where temperatures can be extreme. It is envisioned that the bonding of polymer component 40 (and shoulder 70) will withstand very high temperatures without separation and/or with use of fastener 72 such separation will be inhibited or prevented. Polymer component 40 is made of fire retardant material. Accordingly, the features presented in FIG. 6 provide a mullion with an enhanced fire rating.

Figure 7:
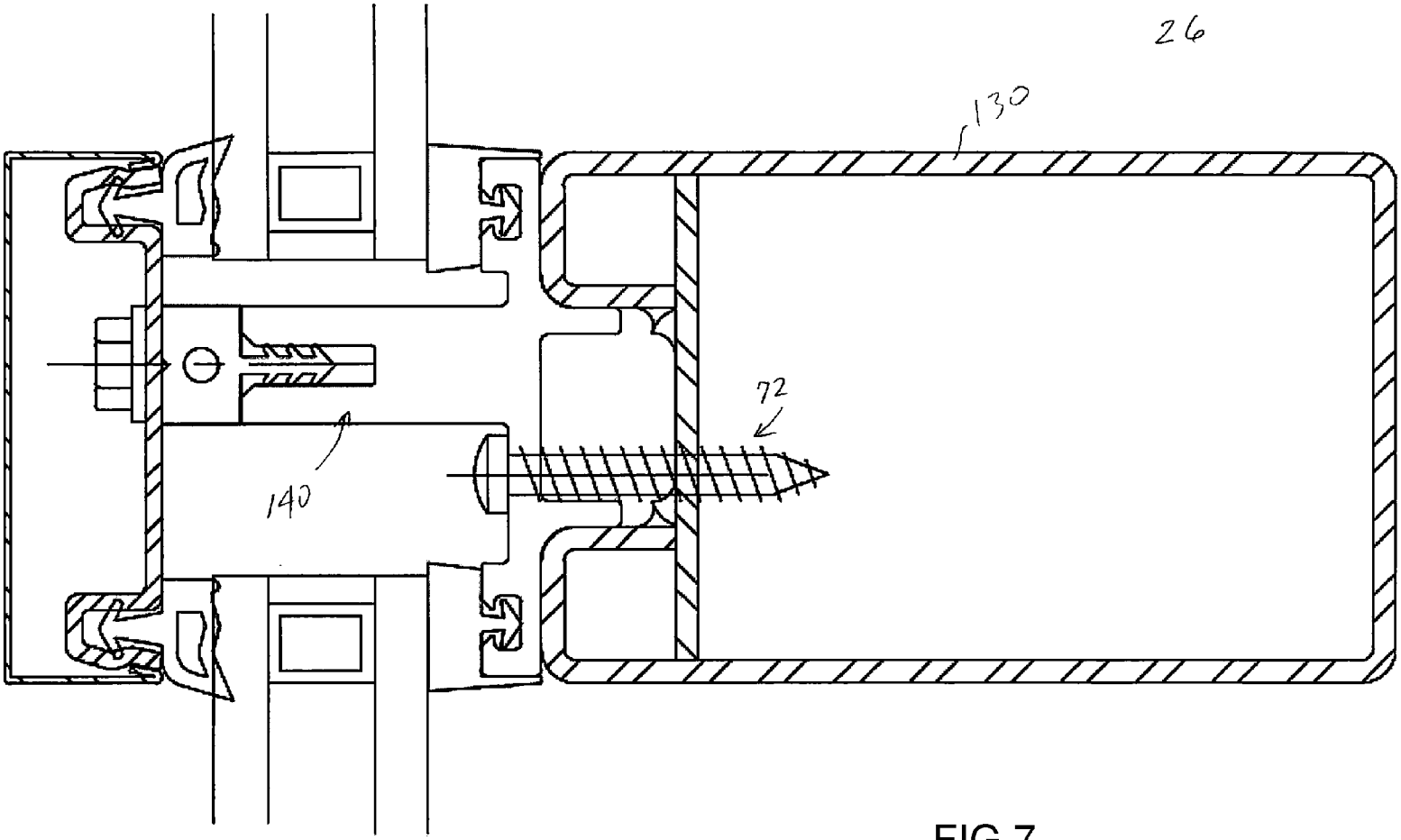
FIG. 7 is a sectional view of a transom along line 3-3 of FIG. 1, according to some further embodiments.

FIG. 7 shows transom 26 where fastener 72 is inserted through polymer component 140 where polymer component 140 is also bonded to transom 26. This arrangement has similar separation inhibiting aspect as noted with FIG. 6.

Figure 8:
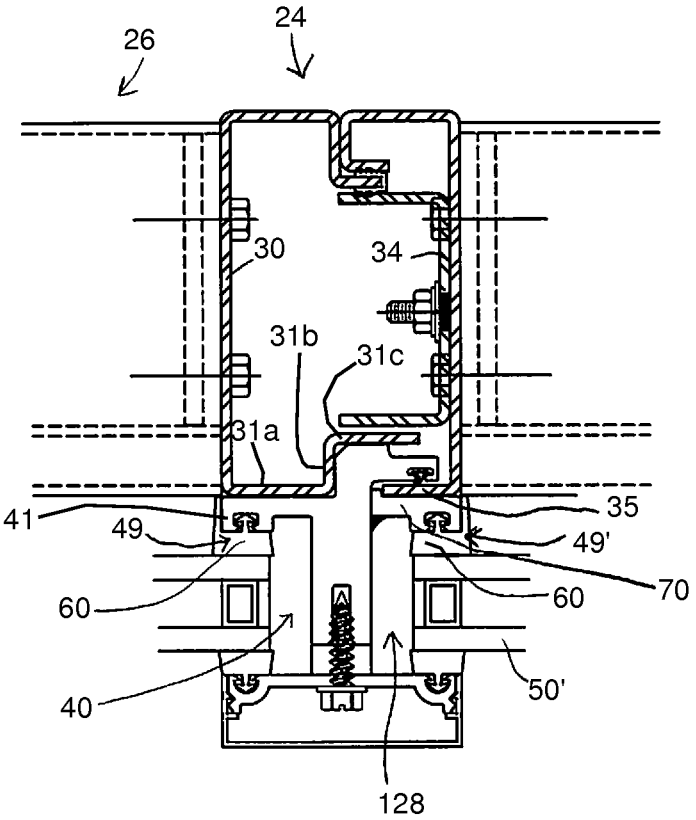
FIG. 8 is a sectional view of a mullion along line 2-2 of FIG. 1, according to some further embodiments.

FIG. 8 shows a polymer component 40 bonded to mullion 24. In this aspect mullion includes first mullion segment 30 having a tail 31*a* leading to arm 31*b* and hand 31*c*. Arm 31*b* extends from tail 31*a* in a generally perpendicular orientation. Hand 31*c* extends from arm 31*b* in a generally perpendicular orientation. Component 40 is bonded to segment 30 at tail 31*a*, arm 31*b* and hand 31*c*. Mullion 24 also includes second mullion segment 32 which includes shoulder polymer component 70. Component 70 is made of the same or similar material as component 40. Component 70 is bonded to segment 32 at tail 35. It may be appreciated that the exterior surface of tail 35 is covered from the atmosphere or from communication with panel 50' or pocket 128. It may also be appreciated that the exterior surface of segment 30, such as at tail 31*a*, arm 31*b* and hand 31*c*, is also covered from the atmosphere or from communication with panel 50 or pocket 128. Component 70 may wrap at least in part at a tip of tail 35. Component 40 and component 70 include seal receiver 49, 49' to receive respective seals 60.

Figure 9:
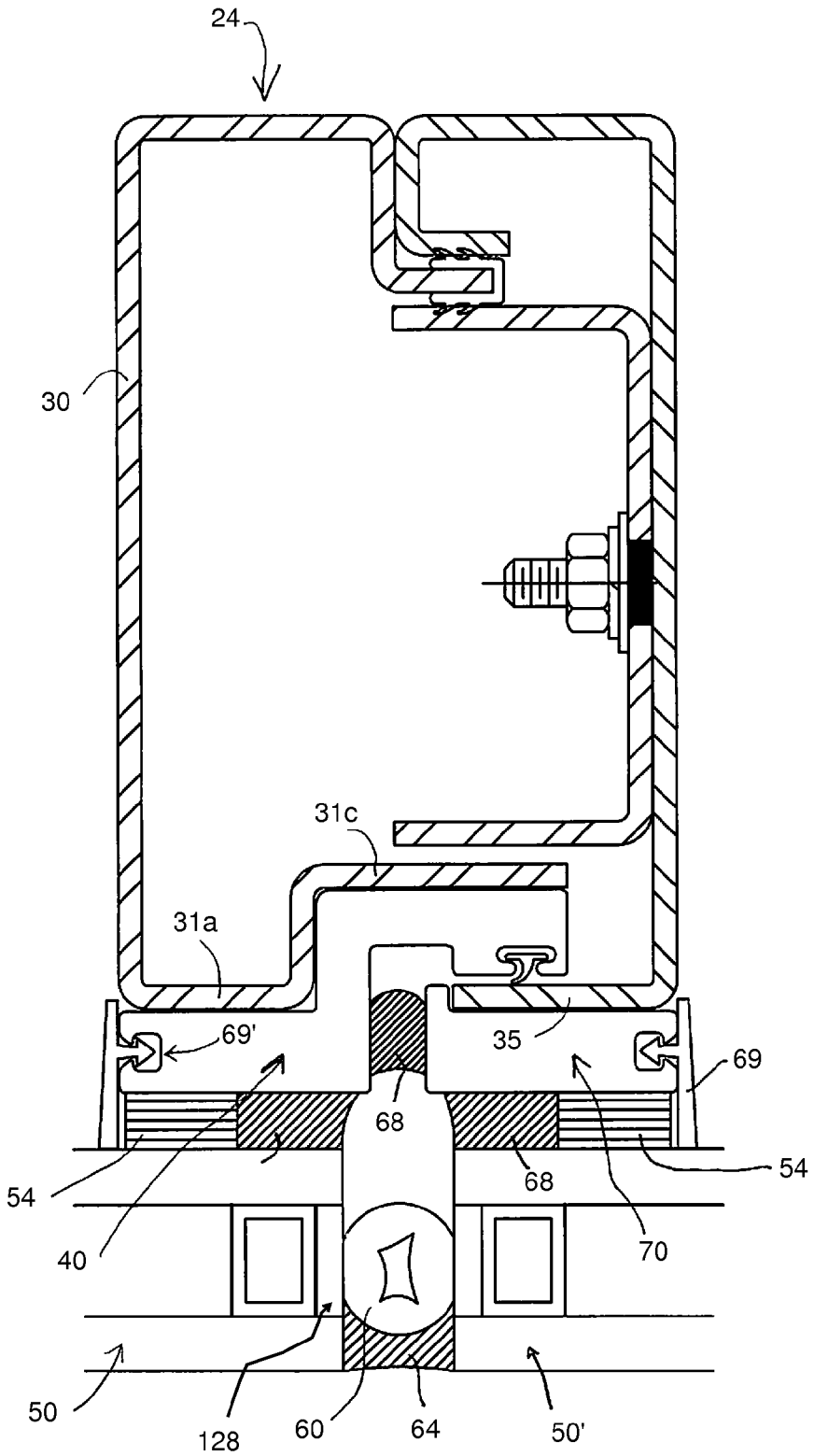
FIG. 9 is a sectional view of a mullion along line 2-2 of FIG. 1, according to some further embodiments.

FIG. 9 shows a polymer component 40 and a polymer component 70 bonded to mullion 24. The bonding is achieved by use of an adhesive applied. In this aspect component 40 is devoid of a stem and does not include an element which projects into pocket 128. Panels 50, 50' are secured to component 40 and component 70, respectively, with glazing tape 54 and structural silicone 68. A sealant 64 and seal 60 are applied between panels 50, 50'.

Figure 10:
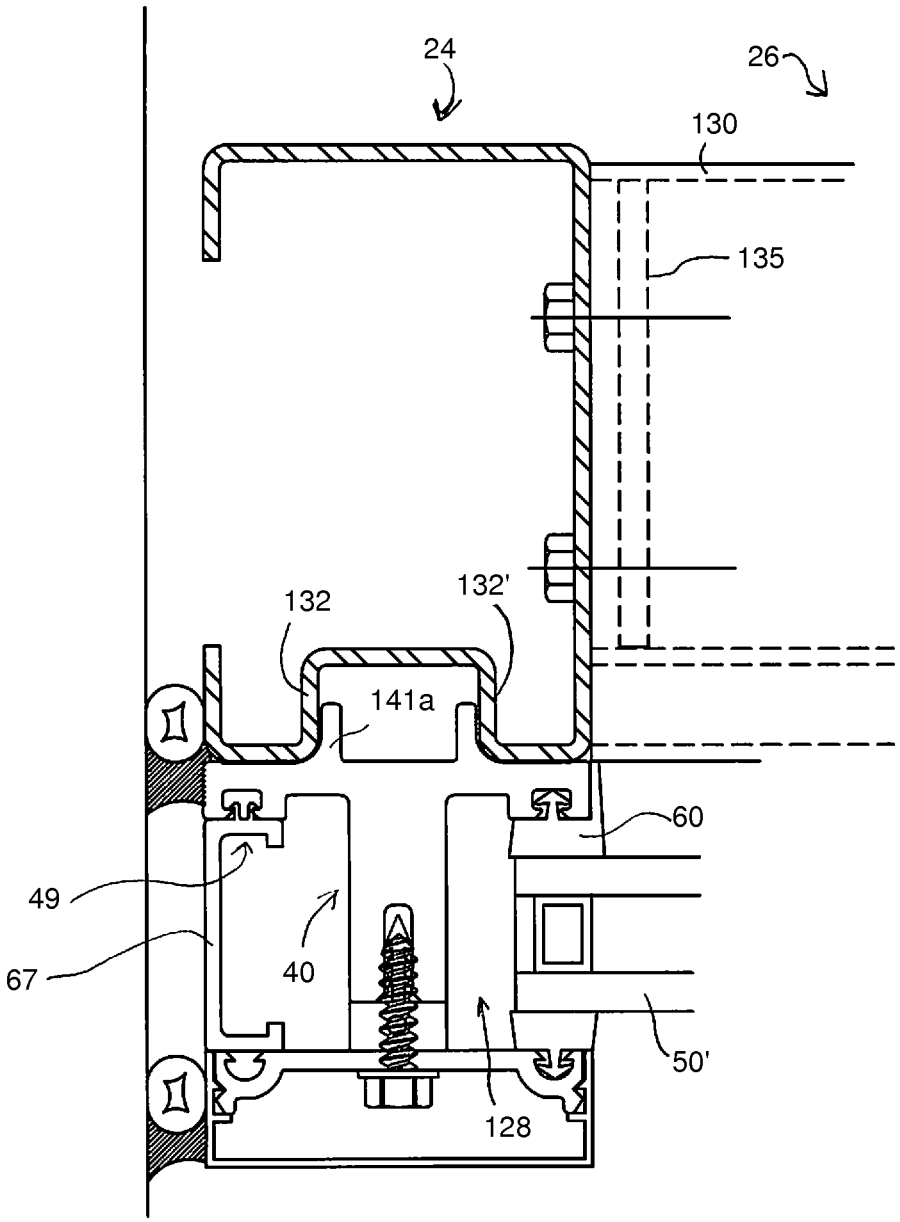
FIG. 10 is a sectional view of a mullion positioned along an end wall of FIG. 1, according to some further embodiments.

FIG. 10 shows a polymer component 40 bonded to mullion 24. In one aspect mullion 24 is formed of bent sheet steel. In this view mullion 24 is positioned adjacent or against a vertical wall and connects with a transom 26 having wall 130. Transom 26 also includes an end plate 135 welded at an end of transom 26. End plate 135 receives fasteners which pass through mullion 24. A single segment mullion 24 is configured with opposing walls 132, 132' to accommodate adherence of fingers 141*a*, 141*b*. Segment 40 is bonded to mullion 24 as noted above with respect to the further aspects. Segment 40 includes seal receivers 49, 49' to receive a seal 60 and/or a PVC spacer 67. It may be appreciated that an entirety of an outside surface of mullion 24 is isolated from the atmosphere or from communication with panel 50' and/or pocket 128. It may be appreciated that panel 50' may also be fastened to mullion 24 by use of glazing tape and silicone gasket as desired (and as an alternative to use of a fastener and/or stem 80).

While there are some curtain wall systems made of metal, most are made of aluminum. Some curtain wall installers may not appreciate the difficulties in working with steel systems due to the need to assure non-exposure of parts to the atmosphere or water which would otherwise result in deterioration, or for other reasons (or if they do, the exactness of the installation may require extra time and expense to complete the project). A tradesman accustom to installing aluminum systems might be more apt to make a mistake in dealing with steel, or if a mistake is made, the resulting damage is, or can be, much more significant as compared to a mistake in installing an aluminum system.

Accordingly, use of a system where the fiberglass reinforced polymer elements act as the stem and/or cover the face side of mullion 24 (or transom 26) is desired. It would not matter if an installer would be concerned about confronting a steel mullion structure as opposed to an aluminum structure since either may be configured to prevent exposure of the frame element (while also providing improved insulating aspects).

Mullion 24 may be of varying lengths depending on the desired application. In one example, mullion 24, and thus segment 30 may have a length of up to 24 feet, or at least 24 feet. A press that is 24 feet long, or at least 24 feet long may be used to form mullion 24 at such length. Mullion 24 may also be of smaller length as desired and smaller presses and tooling may also be used. Mullion 24 may be formed at a variety of widths. In one example mullion 24 may vary in width from 1¾ inches (45 mm), for instance, to 4 inches (100 mm) or more, and may vary in depth from 4 inches (100 mm), for instance, up to 16 inches (405 mm) or more. Different lengths, widths and depths and other dimensions may also be used as desired.

All of such variously dimensioned mullions and transoms and individual segments can be manufactured using the same tooling and break press machine in a bending process. In another example mullion and transom may be manufactured using a roll forming technique. In a roll forming technique different tooling would be used to manufacture mullions or transoms having different dimensions. By utilizing the same break press machine and tooling, however, a variety of dimensions with custom or various profiles may be formed at lower cost. Steel cannot be extruded, or is extremely difficult or impossible to extrude with present or typical machinery or methods. Bending of steel is used to provide the profile as shown in the Figures, for example.

The bending of steel by use of a press brake and tooling to make curtain wall components or segments as presented at such lengths and tolerances has heretofore never been done before or even appreciated as being capable of accomplishment (despite a long-felt need in the market). This is remarkable especially due to the complexities, uncertainties and difficulties given the need for particular tolerances and lengths of products and equipment, together with the difficulties in handling the products and the precise nature required for creating the products and associated equipment. Until the present invention there has been a lack of appreciation of the opportunity to utilize press-brake bending of steel for creating curtain wall segments. Press break bending has not been utilized for creating curtain wall products having lengths of 24 feet, or even greater than 20 feet. Applicant appreciates the difficulty in obtaining or maintaining required tolerances along the entire length of the segments, for instance, the need to have clean or complete folds or bends (which also avoid fracture or cracking during forming) that run uniformly along the entire profile length of the lengthened steel products. An added benefit of using a press brake forming process under the invention is that the steel curtain wall segments may be customized to accommodate different depths or other dimensions (while still maintaining desired tolerances and long lengths) without having to purchase or design new equipment or tooling.

A method aspect of the invention includes bending sheets of steel to make a variety of curtain wall mullion or transom segments and bonding a fiber reinforced polymer element to the structure such that the bonded element extends into a gap defined by two adjacent panels supported by the system. The method includes using a press brake and a set of tooling elements configured for use in conjunction with the press brake to bend a sheet of steel to form a first mullion segment. The bonded segment has a polymer component. The method further includes using the press brake and at least some of the same tooling elements (or all of the same tooling elements) to bend a second sheet of steel to form a second mullion segment. The bonding process may include use of adhesives and curing agents and application of temperature or other bonding techniques to assure a rigid formation of the polymer component to the mullion or transom structure.

A further aspect of the invention includes a method of making a thermally insulating component configured to be bonded to a metal structure where the method comprises pultruding the component with a thermally insulating material through a pultrusion die having a profile perpendicular to the direction of pultrusion including a stem 80 extending in a first direction from a base 81, first arm 144 and second arm 146 extending from opposite sided of base 81 and each extending perpendicular to the stem 80 and each defining a seal receiver 149 having an opening toward the first direction. In a further aspect the stem 80 includes a groove 82 configured to receive a fastener 39. Groove 82 may include a taper 84 to assist in receiving fastener 39. Groove 82 may be a continuous groove which spans the length of component 40, 140. It may be appreciated that groove 82 operates as a pilot hole to receive and contain fastener 39. In one aspect groove 82 is configured to securely receive a fastener such as a screw, including a #14 stainless steel HWH SMS screw. In a further aspect the component profile includes a first finger 141*a* and a second finger 141*b* each extending from base 81 opposite stem 80. Fingers 141 are configured to align with a curve of metal structure 26, and particularly configured to conform to opposing hands 132, 132'. While other arrangements are available, in one aspect fingers 141 are symmetrically separated by a distance greater than the width "w" of stem 80. The thermally insulating component 40 may be pultruded from fiberglass material, and may also include reinforcing mats and an exterior surface may include a heat set resin coating. In further aspects the invention includes the method of pultruding the various thermally insulating components 40, 140 (and components 70, 170, 270) as described herein.

A further aspect of the invention includes a method of bonding a thermally insulating component to a metal structure. The metal may include steel, aluminum, alloys or other metals. In one aspect the method includes providing an adhesive between a pultruded fiberglass material and an outer side 125 of metal structure 26. In one aspect the fiberglass material is a polymer component 40 having fingers 140 that fit with respective hands 132 of the metal structure 26. In further aspects the method includes bonding the component 40 to the cover the entirety of the outer side 125 of metal structure 26.

Figure 11:
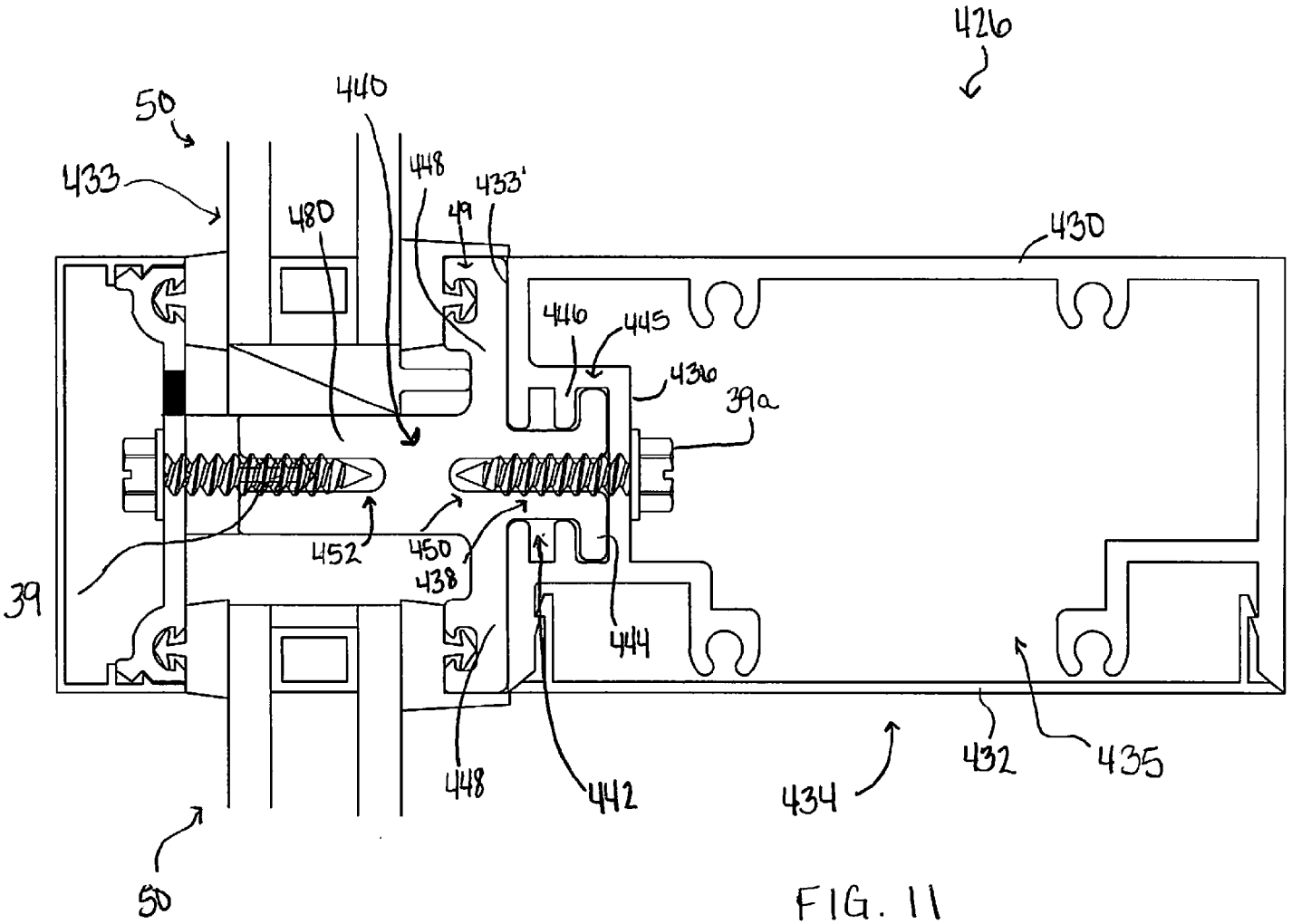
FIG. 11 is a section view of a transom according to some further embodiments.

FIG. 11 is a section view showing a further aspect of the invention. Transom 426 is a metal structure and includes a metal first segment 430 and a metal second segment 432 connected thereto. Segments 430, 432 may be made of extruded metal such as aluminum. Segment 432 may snap-fit into connected position. Transom 426 has an outer side 433 which is oriented toward or facing panels 50 or an outside of the building to which transom 426 is connected. Segment 430 includes an access port 434 such that when segment 432 is not connected to segment 430, access is made available to inside 435 of transom 426. Particularly, access may be made through port 434 such that a fastener 39 may be inserted into and through segment 430. Fastener 39 may be inserted such that a head 39*a* of fastener 39 abuts inner surface 436 of transom 426. In one aspect fastener 39 is inserted through segment 430 to outer side 433 of transom 426.

Transom 426 includes a component 440 connected to transom 426 at outer side 433. Component 440 may be made of materials noted above regarding components 40, 140. In one aspect component 440 includes a head 442 which inserts into a pocket 438 of segment 430. Head 442 may include ear or ears 444 which in one aspect insert into interlocking slots 445 defined at least in part by pocket rib 446. Component 440 also includes shoulder 448 or opposing shoulders 448 which abut transom 426 at outer side 433. Particularly, shoulder 448 abuts and covers outer side face 433' of segment 430. It may be appreciated that component 440 abuts and covers the entirety or substantially the entirety of outer side 433 of segment 430. Covering the entirety of outer side 433 isolates the metal transom 426 from the outside and insulates transom 426. Component 440 also defines a bore such as head bore 450 which is configured to receive fastener 39. Head bore 450 opens toward head 442 such that fastener 39 penetrates through segment 430 and into bore 450. Bore 450 is a closed bore in that bore 450 is closed opposite head 442 (i.e., the bore does not run through the component). In this manner component 440 may be fastened to transom 426 without exposing any part of transom or outer side 433 to the elements. There are no perforations made through component 440 which would otherwise tend to cause moisture or cold or outside air to contact transom 426. Bore 450 also allows for efficient insertion or securing of fastener 39 to component 440. Given the nature of the materials used to make component 440, such as in one instance component 440 is made of reinforced fiberglass, bore 450 allows the fastener 39 to penetrate or connect to component 440 without undue trauma to component 440. The absence of bore 450 might otherwise cause component 440 to splinter or crack or otherwise become weak when fastener 39 is inserted. In one instance fastener 39 includes self-threading threads which impart corresponding thread grooves in component 440 at bore 450. Opposite from bore 450 is stem bore 452 defined by stem 480. Bore 452 receives a fastener 39. Fastener 39 may secure pressure plate to transom 426. Bore 452 opens outward and has a closed end or bottom oriented toward segment 430. Shoulder 448 may include a seal receiver 49 to receive a seal 60. Seal 60 abuts panel 50. A spacer or setting block 37 is positioned on component 440 at stem 480. Upon block 37 rests panel 50. It may be appreciated that panel 50 will have a weight and the weight is supported by component 440. Component 440 extends between or into a gap between panels 50, 50. In this manner component 440 is a structural support of panel 50. It may be appreciated that component 440 may extend the entire length or substantially the entire length of the face or outer side 433 of segment 430.

In one aspect component 440 is positioned within pocket 438 of segment 430 by longitudinally inserting head 442 into pocket 438 and sliding component 440 longitudinally within pocket 438. Component 440 and segment 430 may be placed end-to-end for sliding action. Once head 442 and component 440 are slid into position within pocket 438, a fastener 39 or series of fasteners may be secured to transom 426. Particularly, a fastener 39 is positioned to inside 435 and placed against inner surface 436. A drill or screw driver is activated to drive fastener 39 through segment layer 430 and into bore 450 of head 442 of component 440. A series of fasteners 39 may be inserted along the longitudinal aspect of component 440. Fasteners 39 may be inserted via angled drill/drive devices. Fasteners 39 may be inserted robotically. After insertion of fasteners 39, second metal segment 432 is connected to first metal segment 430 to form transom structure 426. In a further aspect, component 440 may also be bonded to metal segment 430. In one instance shoulder 448 may be bonded to outer side face 433' with an adhesive. A heat treatment may also be applied to assist with the bonding. An adhesive layer may also be inserted into or used to fasten shoulder 448 to segment 430. Adhesive may also be used to secure head 442 within pocket 438. Various designs and configurations of head 438 may be used.

In further respects an aspect of the invention includes the component 440 itself. Component 440 is a thermally insulating fiberglass reinforced polymer component 440. Component 440 is for use with a curtain wall mullion 426 or transom of a curtain wall system. In one aspect component 440 includes a head 442 configured to insert into a pocket 438 defined at an outer side 433 of a metal mullion or transom 426 of the system. Opposing shoulders 448 define seal receivers 49 configured to receive a seal oriented to abut a panel 50 of the system. Each of the shoulders 448 are configured to about the outer side 433 of the metal structure 426 such that component 440 covers substantially an entirety of the outer side 433. As shown in FIG. 11, component 440 covers the entirety of the outer side 433 at outer side face 433'. A stem 480 is configured to project into a space between a first panel 50 and a second panel 50 of the system. Stem 480 provides structural support of the panel 50. Component 440 comprises a unitary thermally insulating fiberglass reinforced polymer. In further aspects component 440 comprises pultruded fiberglass reinforced polymer. The head 442 defines a head bore 450 configured to receive a fastener 39 inserted through the metal structure 426 and into the component 480. In further aspects, stem 480 defines a stem bore 452 configured to receive a fastener 39. The fastener 39 received in stem bore 452 may be of a different, or the same, variety as the fastener received at head bore 450. Stem bore 452 in one aspect is oriented opposite head bore 450.

Figure 12:
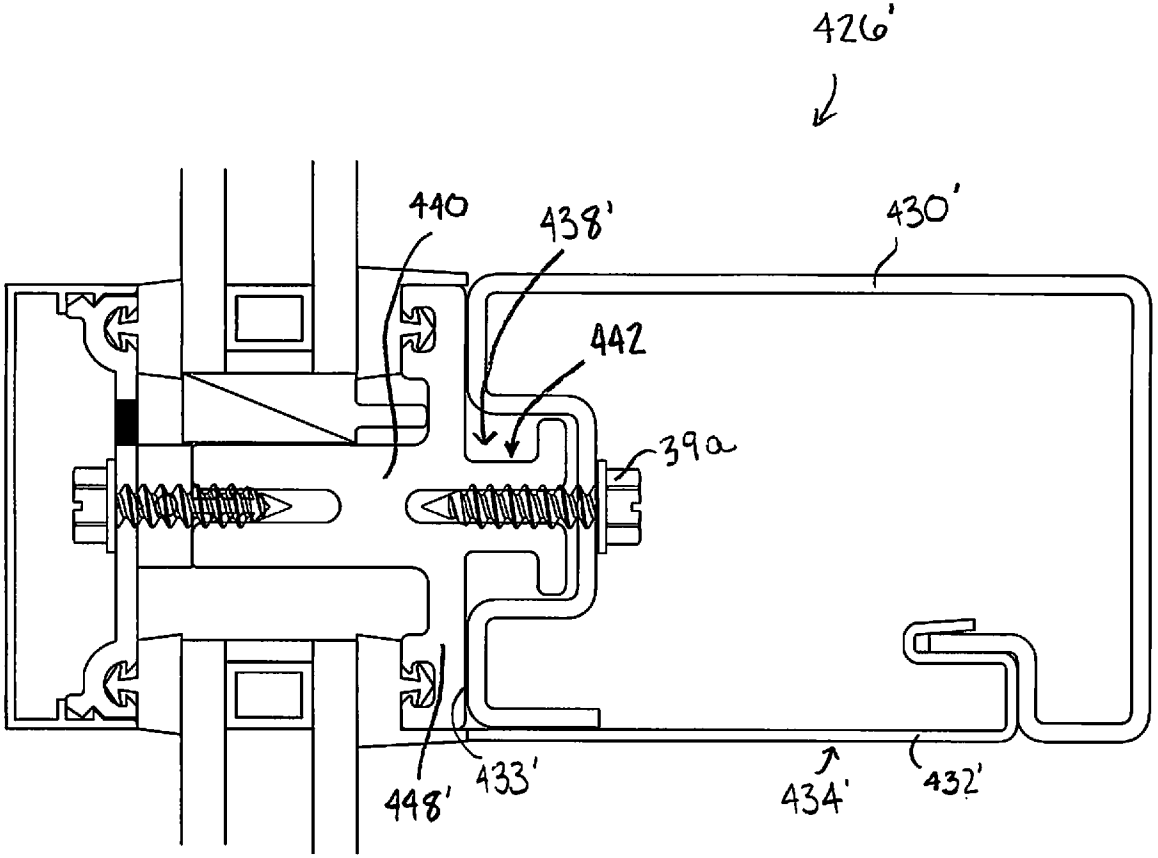
FIG. 12 is a sectional view of a transom according to some further embodiments.

FIG. 12 is a section view of a further aspect of the invention. Transom 426' is a steel transom having a steel first segment 430' and a metal second segment 432' which may also be made of steel. Segment 432' may slide into connected position and friction fit into secure placement. Access port 434' is used to insert fastener 39 through segment 430' and into component 440. Shoulder 448' is connected to outer side face 433. An adhesive and heat and pressure techniques may be used to secure or bond shoulder 448' to outer side face 433'. An adhesive layer may be inserted between shoulder 448' and face 433'. Fastener 39 is inserted from within segment 430. Several fasteners 39 may be inserted though segment 430 to secure component 440 along the longitudinal length of segment 430'. It may be appreciated that with the design of pocket 438' (which lacks ribs 446), head 442 of component 440 may be inserted by translating component 440 into the pocket 438' and without requiring a longitudinal sliding action.

Figure 13:
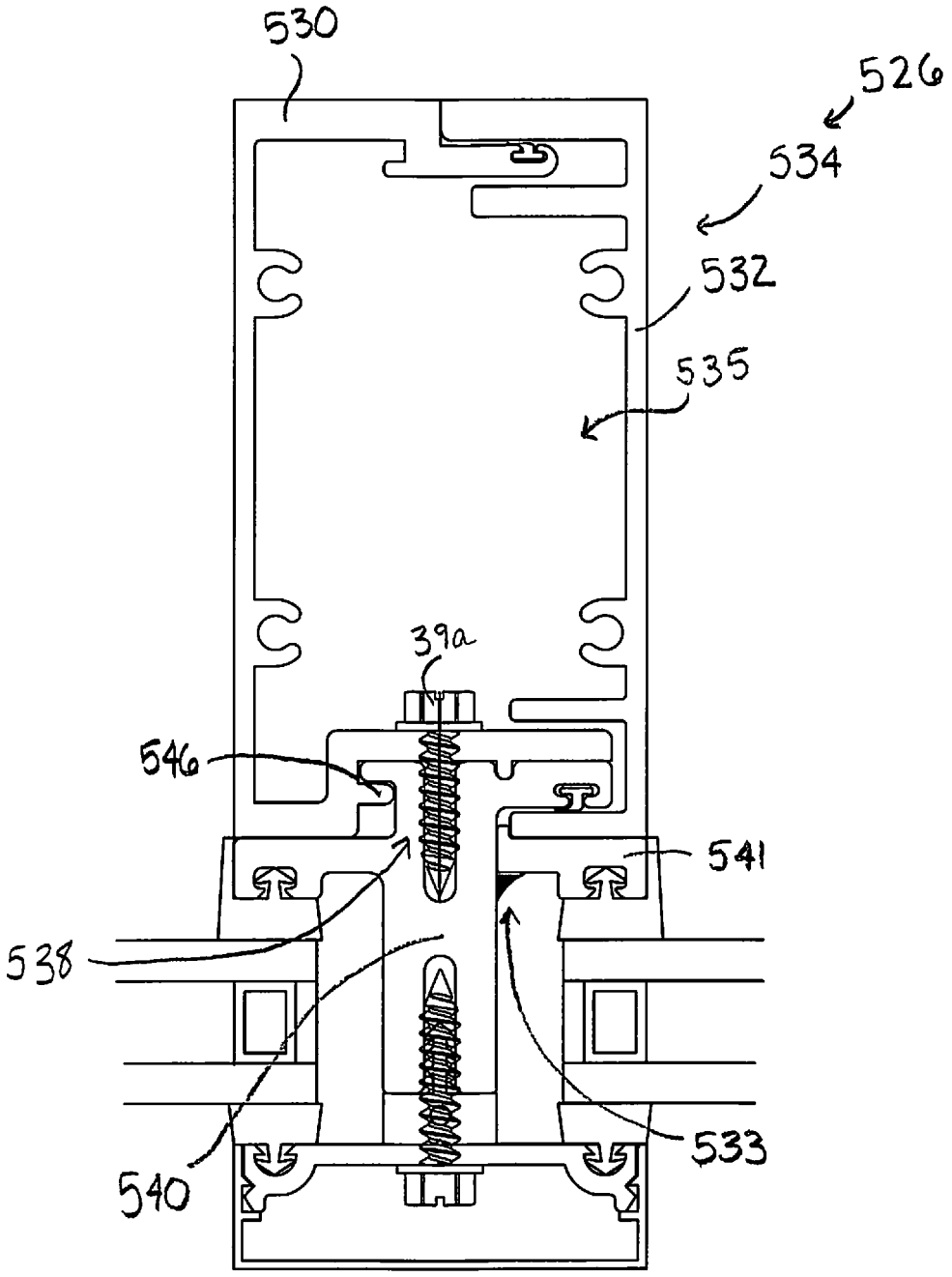
FIG. 13 is a section view of a mullion according to some further embodiments.

FIG. 13 is a section view of a further aspect of the invention Mullion 526 is an aluminum mullion having first segment 530 and a second segment 532 connected thereto. Fastener 39 may be positioned at inside 535 of mullion 526 and driven through wall of segment 530 into component 540. Component 540 includes a head which inserts into pocket 538. Pocket ribs 546 may be used as interlock elements to assist in locking component 540 or aligning component 540 within pocket 538. An additional component 541 may also be connected to segment 532 such that together component 540 and component 541 cover an entirety or substantially the entirety of outer side 533 of mullion. Component 541 may be made of the same or similar material used to make component 540, and in one aspect is a fiberglass reinforced polymer and in further aspect is an insulating pultruded fiberglass reinforce polymer.

Figure 14:
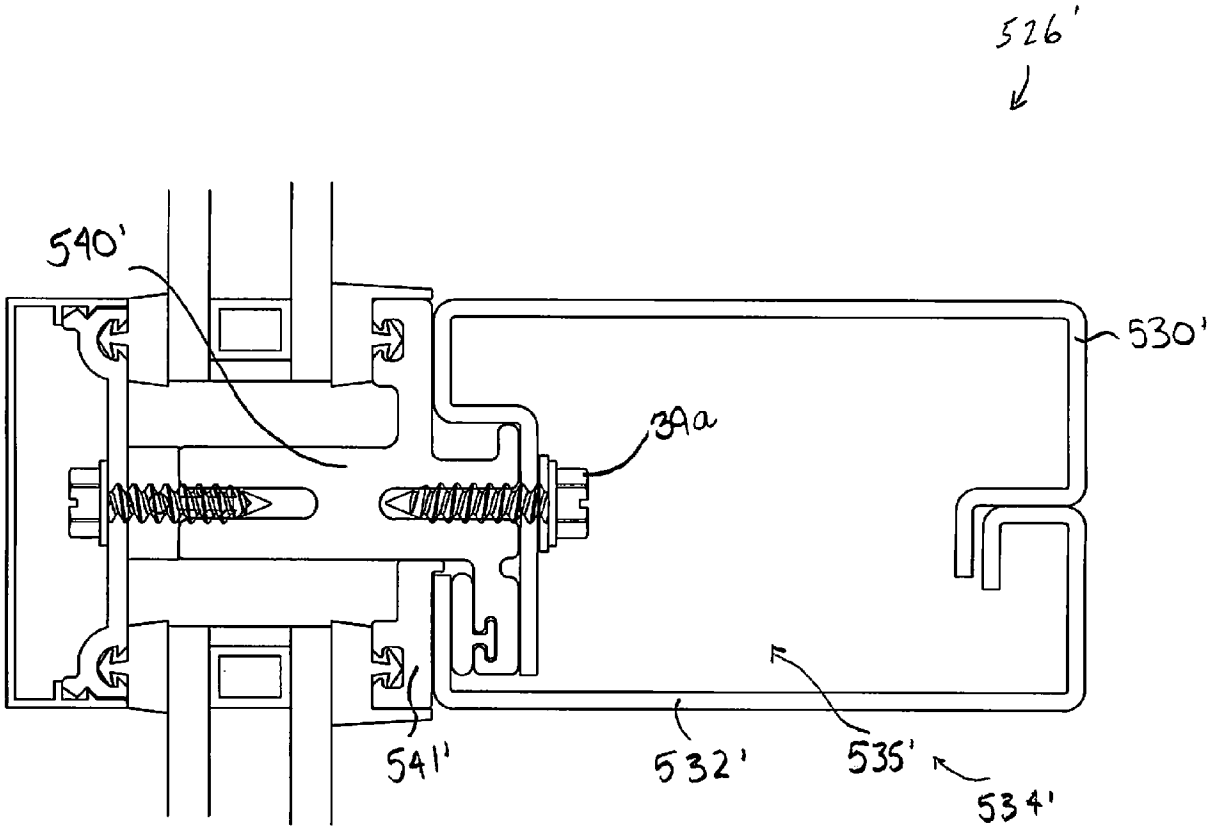
FIG. 14 is a section view of a mullion according to some further embodiments.

FIG. 14 is a section view of a further aspect of the invention. Mullion 526' is a steel mullion having a first segment 530' and a second segment 532' connected thereto. Second segment 532' may also be made of steel. Component 540' is secured to segment 530' with a fastener 39. An optional washer may be placed between fastener 39 and the inner surface 536 of segment 530'. An optional washer may also be used with the other aspects described herein. A second component 541' may be connected to segment 532'. Component 541' may be bonded to segment 532'. Second component 541' may also be connected to segment 532' with a fastener which runs from inside 535' of mullion 526 through a wall of transom segment, either 530 or 532, and into component 541.

Figure 15:
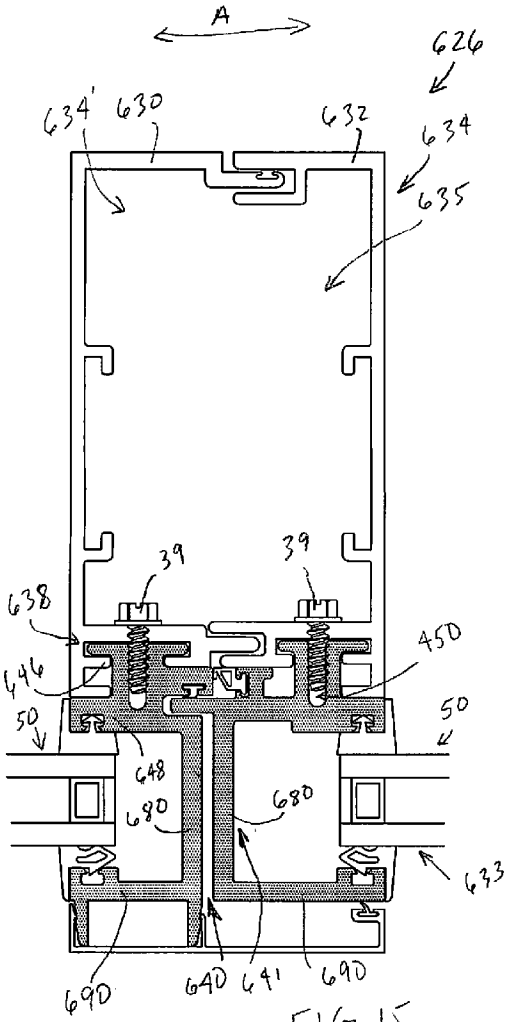
FIG. 15 is a section view of a mullion according to some further embodiments.

FIG. 15 is a section view of a further aspect of the invention. Mullion 626 includes a metal segment 630 and a second metal segment 632 which slide together for an adjustable connection. For instance, segments 630, 632 may slide relative to each other in the direction of arrow A to form a mullion 626. A fastener 39 inserts from inside 635 of segment 630 through a wall of segment 630 and into component 640. Component 640 may be made of a polymer material as noted herein. Component 640 is connected to segment 630 by fastener 39. Interlock rib 646 may be used to form an interlock to secure component 640 within a pocket 638. Component 640 is slid longitudinally into pocket 638 to be secured to segment 630 and/or secured via fastener 39 and/or both. An adhesive may also be used to secure component 640 to segment 630. An adhesive bonding may be used together with a fastener and also together with an interlock as desired. As shown in FIG. 15, a rib or ribs and pocket similar to rib 646 and pocket 638 may also be provided by segment 632 to secure component 641. An interlock and/or fastener 39 and/or both and or adhesive and/or all of such connections may be used to connect component 641 to segment 632. An adhesive may also be used, including an adhesive layer together with heat and pressure treatments used to bond or secure component 640, 641 to mullion 626.

Component 640, 641 includes stem 680 which extends between panels 50. A leg 690 wraps laterally and over (and covers) a portion of panel 50 as shown. A portion of panel 50 is also covered by shoulder 648. Shoulder 648 and leg 690 each define a seal receiver 49. Component 640 may be secured to segment 630 using several fasteners 39. Thereafter panel 50 may be secured using component 640 and with seal placed in seal receivers 49 and adhered to panel 50. Likewise, component 641 may be fastened to segment 632 with several fasteners 39 and then panel 50 connected to component 641 by use of seals and adhesive. Segment 630 and segment 632 may then be slid or adjustably connected together. The segments 630, 632 may also be conveniently disconnected by relative sliding along direction of arrow A. When segments 630, 632 have been connected together, mullion 626 may be connected to the building structure. It may be appreciated that an entirety or substantially the entirety of outer side 633 of combined segment 630, 632 (or of individual segments 630, 632) is covered by components 640, 641 with portions of components 640, 641 contacting segments 630, 632. Further, it may be appreciated that no pressure plate or exterior fastener is required to secure panel 50 to segments 630, 632. In one aspect, components 640, 641 comprise pultruded fiberglass polymer and are configured to wrap about the edge of panel 50. Components 630, 632 define bore 450 to receive fasteners 39.

Figure 16:
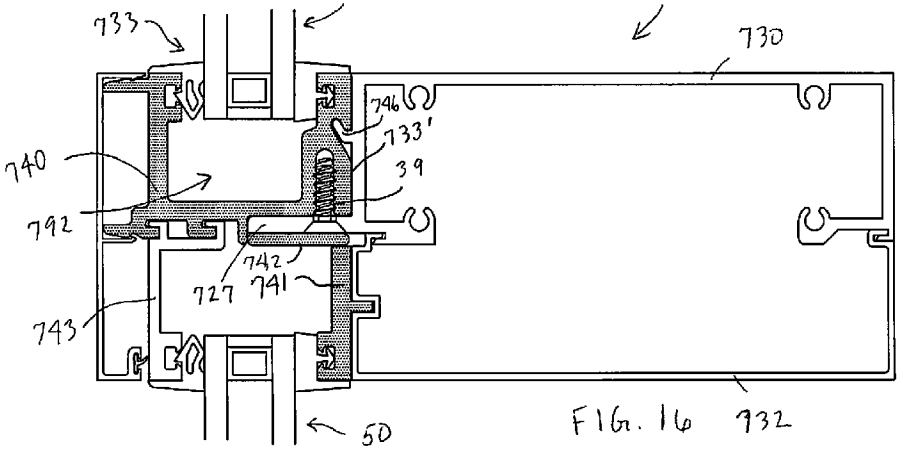
FIG. 16 is a section view of a mullion according to some further embodiments.

FIG. 16 is a section view of a further aspect of the invention. Transom 726 includes metal segment 730 and metal segment 732 connected thereto. A wing 727 projects from segment 730 to a gap between panels 50, 50. Fastener 39 is secured through wing and into component 740. Component 740 may include a bore to receive fastener 39. In one aspect wing 727 projects perpendicularly or generally perpendicularly from outer side face 733'. In one aspect, fastener 39 is oriented perpendicular or generally perpendicular to wing 727. Component 740 may be a polymer component as described herein. A second component 741 is connected to segment 732. Component 741 may be connected via adhesive or bonding. A fastener may also be secured from and through inside of segment 732 and into component 741. In further aspects component 741 may include a bore to receive a fastener. Component 740 wraps around to both sides of panel 50 as shown. An entirety of outer side 733 of combined segment 730, 732 is covered by components 740, 741, 742. Such components 740, 741, 742 also contact outer side 733 of segments 730, 732. Component 741 may include an interlock which inserts into a corresponding interlock of segment 732. Component 741 may also include a seal receiver which receives a seal to abut against panel 50. An additional component 742 may be used to cover wing 727 as shown and to provide further insulating protection of segments 730, 732. Component 742 may be connected to wing 727 by adhesive and/or a fastener. A further component 743 includes a seal receiver and receives a seal to abut against panel 50. Component 743 may comprise a metal or in other aspects may also comprise a fiberglass component. An end of component 743 opposite seal receiver includes a rib or ribs which insert into corresponding rib or ribs of component 740 for secure positioning of component 743. In addition to use of fastener 39, or as an alternative to fastener 39, an adhesive may be used to rigidly bond component 740 to outer side face 733'. Such bonding may be made by use of an adhesive and other forms of bonding may also be used. Additionally, or alternatively, a rib 746 may also be used to secure or assist in rigidly securing component 740 to face 733'. A spacer may be inserted into cavity 792 of transom 726 so that panel 50 may rest against the spacer so that the weight of panel 50 may be supported by component 740. Component 740 may also include a weep hole or weep holes to allow moisture to escape from cavity 792.

Figure 17:
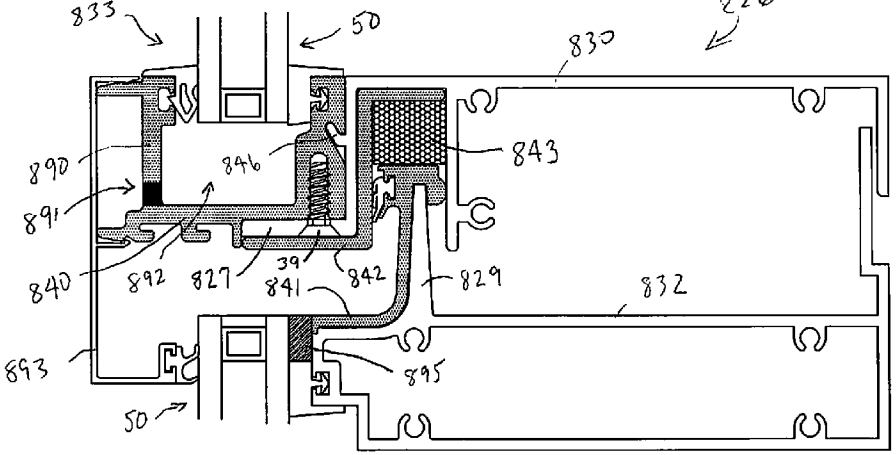
FIG. 17 is a section view of a transom according to some further embodiments.

FIG. 17 is a section view of a further aspect of the invention. Transom 826 includes metal segment 830 which may be aluminum for instance. Segment 830 mates with segment 832 which may also be made of metal such as aluminum. Component 840 is connected to outer side 833 of transom 826. In one aspect component 840 connects to wing 827 and is configured to cover the entire outer side of segment 830. Component 840 may include a bore configured to receive fastener 39 inserted through wing 827. An adhesive may also be used to secure component 40 to segment 830. A strip or sheet of double back adhesive may be used. Heating, pressure and additional bonding techniques may be used to connect a component to the metal herein. Various interlocks, ribs and grooves may also be used to secure component 840 to segment 830. Segment 830 may include a rib 846 or ribs which mate with component 840 for interlocking arrangement. Component 840 may include leg 890 which extends to an outer side of panel 50 and transom 826 and may include a seal receiver to receive a seal to abut against panel 50. Component 840 may also include a weep hole 891 or a series of weep holes to allow moisture to escape from cavity 892. Component 840 includes a further seal receiver to receive a seal to abut panel 50 on an inner side of panel 50. It may be appreciated that component 840 wraps around to both sides of panel 50. A spacer may also be positioned in cavity 892 so that panel 50 may rest upon the spacer which in turn rests upon component 840. Component 840 supports the weight of panel 50.

A component 841 is connected to segment 832 at jaw 829. The entirety of the outer side of jaw 829 is covered by component 841. Component 841 wraps around a tip of jaw 829. Component 841 includes a seal receiver for receiving a seal to abut against an inside of segment 830. An optional air baffle 843 is placed within segment 839. In one aspect baffle 843 may be about 4 inches in length and is positioned where the vertical mullion terminates or at the top of the vertical mullion to prevent air leaks. In one aspect baffle 843 fits snugly into a channel defined in part by various walls of segment 830 as shown. A tip of jaw 829 inserts into the channel and the component 841 abuts baffle 843 which also seals outer face of segment 830 from exposure. Segment 842 is also connected to segment 830 and covers wing 827 and isolates wing 827 and walls of segment 830 from the atmosphere or exposure. It may be appreciated that components 841, 842 may be secured to segments 830, 832 by adhesive, including a double backed strip adhesive and under pressure and temperature for bonding. In alternative aspects components 841, 842 may also be fastened with a fastener. Components 841, 842 may also define respective bores for receiving fasteners. Components 840, 841, 842 may be secured by use of adhesive and/or fasteners and/or interlock/friction fit or all of the same. An end cap 893 connects securely to component 840 via friction fit or snap-n fingers and includes a seal receiver and seal to abut panel 50 which is held in place at panel 832. An adhesive block or connector 895 is used to secure panel 50 to segment 832. It may be appreciated that segment 830 and 832 come together to form transom 826 and the individual segments 830, 832 are connected to respective structure elements of the building to secure transom 826 and panels 50 into position. While the unitized design shown in FIG. 17 depicts a transom made of metal such as aluminum, it may be appreciated that such transom structure may also be made with steel, of course with some structural modifications to accommodate for the bending of the steel segments comprising the transom.

It should be understood, of course, that the foregoing relates to exemplary embodiments of the invention and that modifications may be made without departing from the spirit and scope of the invention as set forth in the following claims. The scope of this invention also includes embodiments having different combinations of features and embodiments that do not include all of the above described features.

What is claimed is:

1. A curtain wall mullion or transom for use on a curtain wall system, said mullion or transom comprising:

a metal mullion or transom structure having an outer side;

a component connected to said metal structure at said outer side by a first fastener having a head, said first fastener passing through said metal structure and into said component, said head positioned at an inside of said structure; and a second fastener passing through a pressure plate and then into said component.

2. The mullion or transom of claim 1 where said head abuts an inner surface of said metal structure.

3. The mullion or transom of claim 1 where said component comprises a thermally insulating polymer component.

4. The mullion or transom of claim 3 where said component comprises a fiberglass reinforced polymer and is a structural support of a panel to be used with the system, said component includes a stem configured to project into a space between a first panel and a second panel of the system.

5. The mullion or transom of claim 3 where said component covers substantially an entirety of said outer side.

6. The mullion or transom of claim 1 where said component is devoid of penetrations passing through said component.

7. The mullion or transom of claim 3 where said component defines a first seal receiver configured to receive a seal oriented to abut a first panel of the system and defines a second seal receiver configured to receive a seal.

8. The mullion or transom of claim 1 where said second fastener has a head positioned at an outside of said structure.

9. The mullion or transom of claim 1 where said component includes a head inserted into a pocket defined by said metal structure, said component further comprising opposing shoulders, each shoulder abutting said outer side.

10. The mullion or transom of claim 1 where said component includes a head inserted into a pocket defined by said metal structure, said pocket further having opposing interlock slots to receive opposing ears of said head.

11. The mullion or transom of claim 1 where said component comprises a fiberglass reinforced polymer and includes a head defining a closed bore configured to receive said fastener.

12. The mullion or transom of claim 1 where said metal structure includes an access port configured to allow access to an inside of said metal structure to secure said fastener through said metal structure to said component.

13. The mullion or transom of claim 1 where said fastener has a fastener head which abuts an inner surface of said metal structure, said component is a fiberglass reinforced polymer component which is a structural support of a panel to be used with the system, said component having a stem configured to project into a space between a first panel and a second panel of the curtain wall system, said component further comprising opposing shoulders, each shoulder abutting said outer side such that said component covers substantially an entirety of said outer side.

14. The mullion or transom of claim 1 where said component is a fiberglass reinforced polymer component, said mullion or transom further comprising a second fiberglass reinforced polymer component, said second component connected to said outer side, said second component and said component positioned side-by-side and together covering an entirety of a width of said outer side.

15. A curtain wall mullion or transom for use on a curtain wall system, said mullion or transom comprising:

a metal mullion or transom structure having an outer side defining a pocket; and a thermally insulating fiberglass reinforced polymer component having a head inserted into said pocket and opposing shoulders where each shoulder defines a seal receiver configured to receive a seal oriented to abut a panel of the system, each shoulder abuts said outer side such that said component covers an entirety of said outer side, said component further comprising a stem configured to project into a space between a first panel and a second panel of the curtain wall system, said component having a total length, said head defining a pre-set slot spanning at least substantially the total length, a fastener passing through said metal structure and into said pre-set slot.

16. A curtain wall mullion or transom for use on a curtain wall system, said mullion or transom comprising:

a metal mullion or transom structure having an outer side; and a component connected to said metal structure at said outer side by a first fastener passing through said metal structure and into said component, a second fastener inserted into said component from said outer side, said component devoid of penetrations passing through said component from an outer side to an inner side of said component.

17. The mullion or transom of claim 16 where said second fastener includes a portion extending outward from said component.

18. The mullion or transom of claim 17 where said portion extending outward from said component is positioned at said outer side and includes a head having a diameter larger than a diameter of a body of said second fastener.

19. A curtain wall mullion or transom for use on a curtain wall system, said mullion or transom comprising:

a metal mullion or transom structure having an outer side;

a first component abutting said metal structure at said outer side and connected to said metal structure at said outer side by a first fastener passing through said metal structure and into said component where said component is a fiberglass reinforced polymer component; and at least a second fiberglass reinforced polymer component, said second component abutting said metal structure at said outer side and connected to said outer side such that substantially an entirety of said outer side is covered, said first component and said at least a second component positioned side-by-side along a width of said metal structure.

20. The curtain wall mullion or transom of claim 19 where at least one of said first component or said second component abuts an outer-most surface of said metal mullion or transom structure.

21. The curtain wall mullion or transom of claim 19 where said first component and said at least a second component cover an entirety of said outer side.

22. The curtain wall mullion or transom of claim 19 where said mullion or transom has a first segment configured to connect to a second segment, said first component connected to said first segment, said at least a second component connected to said second segment.

23. The curtain wall mullion or transom of claim 19 where said at least a second component connects to the outer side by adhesive.

24. The curtain wall mullion or transom of claim 19 further comprising at least a third polymer component abutting said metal structure at said outer side and connected to said outer side such that substantially an entirety of said outer side is covered.

25. The curtain wall mullion or transom of claim 19 where said fastener passes completely through said metal structure and is isolated from said outer side.

26. The curtain wall mullion or transom of claim 19 where said metal structure includes an outward projecting wing, said first fastener passes through said wing and into said first component.

27. The curtain wall mullion or transom of claim 19 where said first component wraps about a panel from an interior side of the panel to an exterior side of the panel.

28. The curtain wall mullion or transom of claim 19 where said first component extends over at least a portion of an interior side of the panel and extends over at least a portion of an exterior side of the panel.

29. The curtain wall mullion or transom of claim 15 where said component is a structural component configured to structurally support the first panel or the second panel.

30. The curtain wall mullion or transom of claim 29 where said component is a structural component configured to structurally support an entirety of the first panel or the second panel.

31. The curtain wall mullion or transom of claim 15 where at least a portion of opposed walls of said slot are parallel.

32. The curtain wall mullion or transom of claim 15 where said fastener has a maximum thread diameter, said slot has a depth at last three times the maximum thread diameter.

33. The curtain wall mullion or transom of claim 15 further comprising a spacer block positioned between said stem and the first panel or the second panel.

* * * * *